US011223903B2

(12) United States Patent
Guerrini et al.

(10) Patent No.: US 11,223,903 B2
(45) Date of Patent: Jan. 11, 2022

(54) HEAD SUPPORT INCORPORATING LOUDSPEAKERS AND SYSTEM FOR PLAYING MULTI-DIMENSIONAL ACOUSTIC EFFECTS

(71) Applicant: SOUND6D S.r.l., Ponsacco (IT)

(72) Inventors: Pierpaolo Guerrini, S. Pietro Belvedere (IT); Lando Santerini, Pontedera (IT)

(73) Assignee: SOUND6D S.R.L., Ponsacco (IT)

( * ) Notice: Subject to any disclaimer, the term of this patent is extended or adjusted under 35 U.S.C. 154(b) by 0 days.

(21) Appl. No.: 16/325,588

(22) PCT Filed: Aug. 18, 2017

(86) PCT No.: PCT/IB2017/055018
§ 371 (c)(1),
(2) Date: Feb. 14, 2019

(87) PCT Pub. No.: WO2018/033885
PCT Pub. Date: Feb. 22, 2018

(65) Prior Publication Data

US 2019/0182593 A1 Jun. 13, 2019

(30) Foreign Application Priority Data

Aug. 18, 2016 (IT) ..... IT102016000085931
Aug. 18, 2016 (IT) ..... IT102016000085955

(51) Int. Cl.
*H04R 5/02* (2006.01)
*H04R 5/027* (2006.01)
(Continued)

(52) U.S. Cl.
CPC ..... *H04R 5/023* (2013.01); *A47C 7/38* (2013.01); *A47C 7/727* (2018.08); *A47G 9/1045* (2013.01);
(Continued)

(58) Field of Classification Search
CPC . H04R 5/023; H04R 5/02; H04R 1/26; H04R 2201/023; H04R 1/025;
(Continued)

(56) References Cited

U.S. PATENT DOCUMENTS 4,027,112 A * 5/1977 Heppner ..... B60R 11/0217 381/182
4,991,222 A * 2/1991 Nixdorf ..... H04R 5/023 297/391
(Continued)

FOREIGN PATENT DOCUMENTS

DE 25 45 446 A1 4/1977
FR 2 877 554 5/2006
(Continued)

*Primary Examiner* — Disler Paul
(74) *Attorney, Agent, or Firm* — Stein IP, LLC

(57) ABSTRACT

A device for audio reproduction comprising a rest element for the head of a user, made of a deformable material; a right lateral support element and a left lateral support element located respectively at the two respective right and left of the rest element, the rest and left lateral support elements being connected to each other by the rest element, the right and left support elements defining between each other a listening space and a longitudinal direction parallel to the lateral support elements; a right loudspeaker and a left loudspeaker mounted respectively to the right and left lateral support elements have respective sound emission faces that face towards a listening space defined between the right and left support elements. The rest element provides a housing for a portion of the head configured to arrange the user with right and left ears oriented towards the right and left loudspeakers, the right and left ears creating a listening axis. The loudspeakers have each a woofer and a tweeter, the tweeters having an axis of symmetry oriented with a predetermined angle of elevation (α) with respect to the listening axis between a first elevation value (α) substantially equal to
(Continued)

zero, where the tweeters have the axes of symmetry aligned to each other and parallel to the listening axis, and a second elevation value (α), substantially equal to 45°, where the tweeters have the axes of symmetry converging towards a point that is located higher than the listening axis. A system of binaural recording and a system for playing multi-dimensional effects are also included.

10 Claims, 26 Drawing Sheets

(51) Int. Cl.

| | |
|---|---|
| ***H04R 1/26*** | (2006.01) |
| ***H04S 7/00*** | (2006.01) |
| ***A47C 7/72*** | (2006.01) |
| ***A47C 7/38*** | (2006.01) |
| ***A47G 9/10*** | (2006.01) |
| *A47G 9/00* | (2006.01) |

(52) U.S. Cl.
CPC ..... *H04R 1/26* (2013.01); *H04R 5/027* (2013.01); *H04S 7/30* (2013.01); *H04S 7/302* (2013.01); *H04S 7/303* (2013.01); *A47G 2009/006* (2013.01); *H04R 2201/023* (2013.01)

(58) Field of Classification Search
CPC ..... H04R 5/027; A47C 7/727; A47C 7/38; A47G 9/1045; A47G 2009/006; H04S 7/30; H04S 7/303; H04S 7/302
USPC ..... 381/301, 74
See application file for complete search history.

(56) References Cited

U.S. PATENT DOCUMENTS

| | | | | |
|---|---|---|---|---|
| 5,031,216 | A | 7/1991 | Görike et al. | 381/26 |
| 5,073,936 | A | 12/1991 | Görike et al. | 381/26 |
| 5,684,879 | A * | 11/1997 | Verdick | H04R 1/1075 381/300 |
| 6,744,898 | B1 * | 6/2004 | Hirano | H04R 5/023 381/333 |
| 8,130,987 | B2 * | 3/2012 | Kaneda | H04R 1/26 381/301 |
| 8,566,986 | B1 | 10/2013 | Chu | 5/636 |
| 9,555,890 | B2 * | 1/2017 | Tracy | H04R 5/023 |
| 9,596,544 | B1 * | 3/2017 | Brotherton | H04R 19/02 |
| 9,950,793 | B2 * | 4/2018 | Tracy | H04R 1/025 |
| 10,237,648 | B2 * | 3/2019 | Takada | G10L 21/0232 |
| 10,405,095 | B2 * | 9/2019 | Eichfeld | H04R 5/023 |
| 2016/0023763 | A1 * | 1/2016 | Tracy | B64D 11/00154 381/301 |

FOREIGN PATENT DOCUMENTS

| | | |
|---|---|---|
| WO | WO 96/10884 A1 | 4/1996 |
| WO | WO 98/07299 | 2/1998 |

* cited by examiner

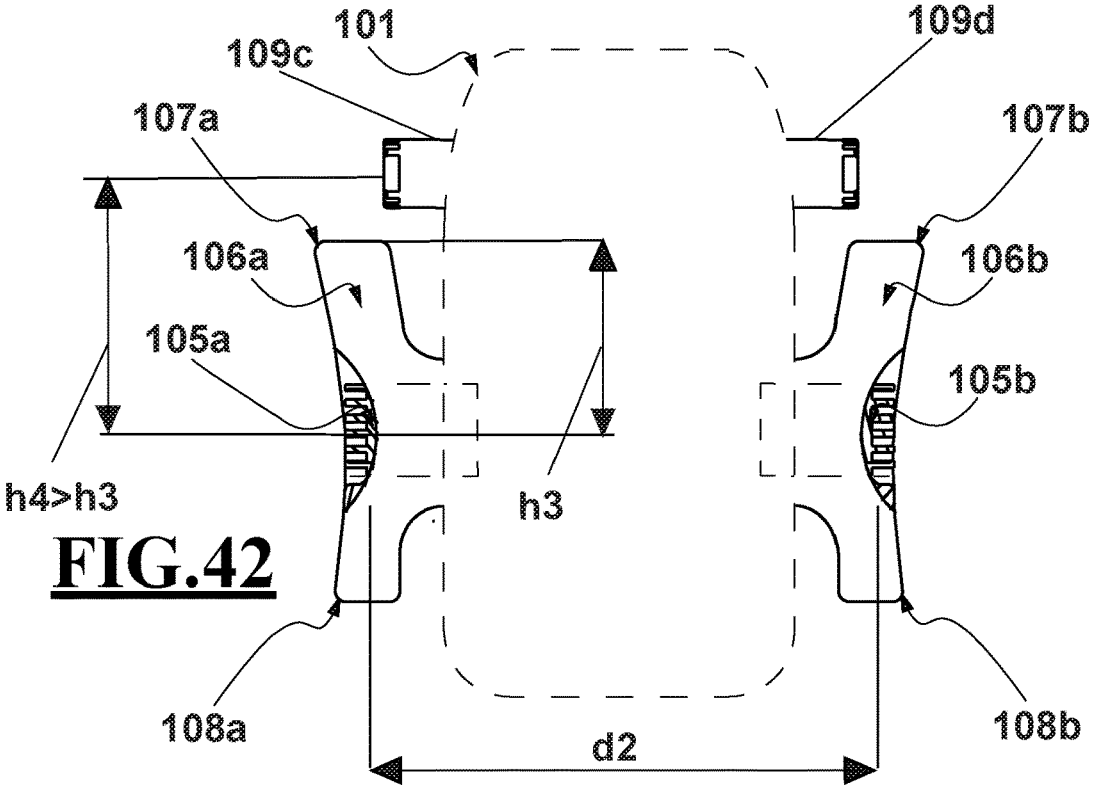
FIG.42
FIG.43
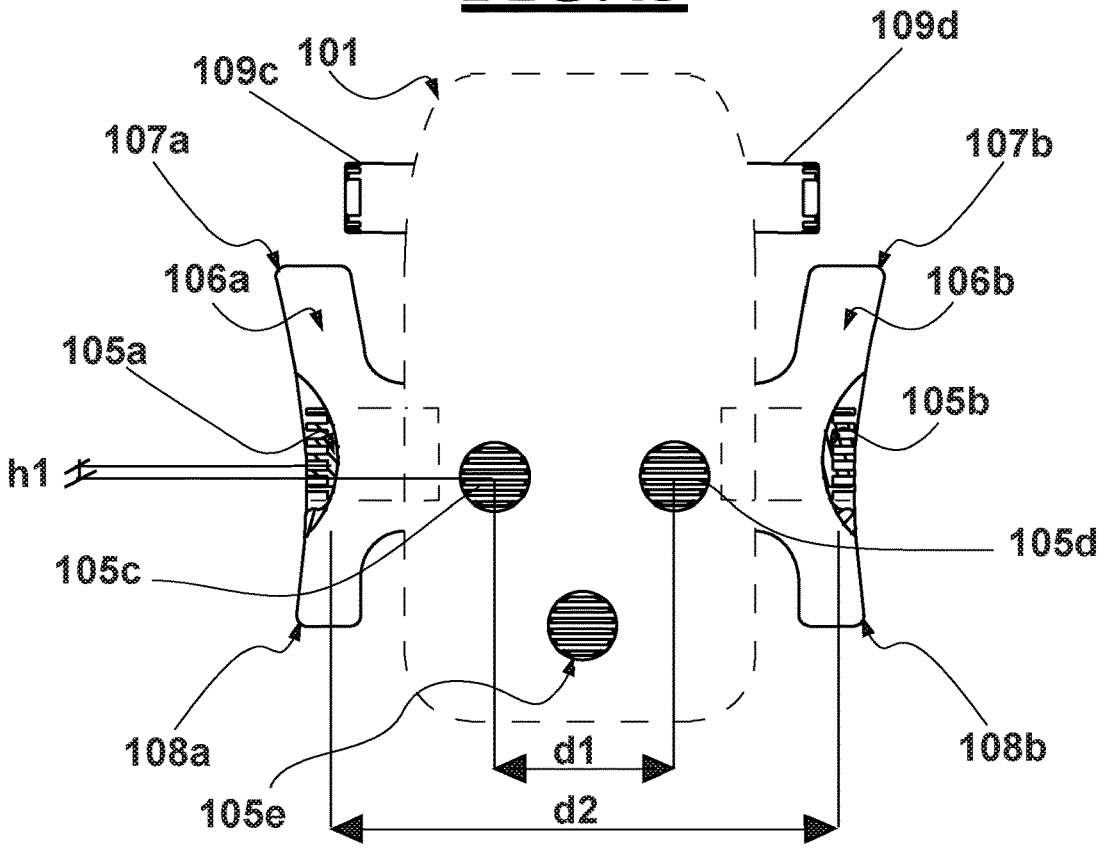

HEAD SUPPORT INCORPORATING LOUDSPEAKERS AND SYSTEM FOR PLAYING MULTI-DIMENSIONAL ACOUSTIC EFFECTS

CROSS-REFERENCE TO RELATED APPLICATIONS

This application is a national stage of International Application No. PCT/IB2017/055018, filed Aug. 18, 2017, which claims the benefit of Italian Application No. 102016000085931, filed Aug. 18, 2016, and Italian Application No. 102016000085955, filed Aug. 18, 2016 in the Italian Patent & Trademark Office, the disclosures of which are incorporated herein in their entireties by reference.

FIELD OF THE INVENTION

The present invention relates to a head support incorporating sound reproduction means. Furthermore, it relates to a system for distributing multi-dimensional effects.

In particular, the invention relates to a head support incorporating sound reproduction means allowing a more reliable perception of sounds recorded with multi-dimensional microphones. These microphones are capable of recording sounds in a reliable way according to their direction, such as front and rear, right and left side, up and down, in order to perceive, when playing, the direction of movement of the sound source with respect to the microphone system used for recording it.

Furthermore, the invention relates to a system of sound reproduction aimed to reproduce desired sequences of sounds and other multidimensional acoustic effects.

The present invention also relates to a microphone that enables a reproduction offering to the listener a more reliable sensation with respect to the real location of the sound sources at the moment of recording, thanks to a head support incorporating loudspeakers or other sound reproduction means.

In particular, the invention relates to a recording system that provides, in a two channel audio reproduction, a perception of the sound in at least six directions of the sound source, such as front and rear, side right and side left, up and down, static or in approaching and moving away directions.

DESCRIPTION OF THE PRIOR ART

Very high fidelity recordings, for example recorded using binaural microphones, like the systems described in U.S. Pat. No. 5,031,216A or in WO9807299A1, are known.

These audio recordings require sophisticated reproduction devices, such as surround systems or high fidelity headphones, in order to reproduce spatial effects such as the sound source direction or a movement direction of the audio source.

Different kinds of loudspeaker incorporating devices, arranged for propagating audio recordings, in order to let a single user to hear it, providing also a comfortable support for the head, are known. Such devices, also called "musical pillows", combine the comfort of the headrest with musical entertainment provided by integrated loudspeakers. These devices can be used at home as well as in professional context, i.e. wellness centers, massage centers, waiting rooms, centers of music therapy, etc.

U.S. Pat. No. 8,566,986B1 describes an example of a musical pillow. The device comprises, in particular, a central body fitted with a circular opening arranged to receive the face of the user in prone position and an electronic board for controlling a vibration unit and a rotation unit. The system also comprises two lateral bodies, each of which is equipped with a speaker connected to the electronic board and to the rotation unit. This way, the two lateral bodies can rotate starting from a first position, coplanar with the central body, to a second position, orthogonal with the central body. The system also comprises a control unit for activating through the electronic board the vibration unit and the rotation unit. Input channels for receiving audio data and playing the loudspeakers located in the two lateral bodies are also present.

This device has the advantage to provide a comfortable support for the head of the user, for any sleeping position, while listening. Furthermore, the lateral bodies can be oriented starting from a position of minimum encumbrance where the two lateral bodies are coplanar with the central body. The portal frame allows the user to listen in a sleeping position by placing the central body of the device on a horizontal plane. However, this device is not designed for listening multi-dimensional audio recordings.

FR2877554A1 describes another multifunctional device comprising a rectangular base in elastic material and two lateral walls. Each lateral wall is arranged at the right and left sides of the base and includes a loudspeaker. Furthermore, a cover fabric is used as tension element for the orthogonal positioning of the two lateral walls, with respect to the base. This way, a good stereophonic listening is obtained from the loudspeakers that are orthogonal to the base. The system also comprises a shape-memory rectangular element arranged to house, in a comfortable way, the back of the head of the user. In particular, such device adapts its shape according to the weight of the head of the user.

Generally, the above described systems have the drawback of not providing a listening of the played sound that allows a realistic perception of the conveying direction of the original sound, if the sound source comes from high fidelity recording systems as described in U.S. Pat. No. 5,031,216A and WO9807299A1, above cited.

There are also systems of binaural recording, as described for example in WO96/10884A1, DE2545446A1, U.S. Pat. No. 5,073,936, which give to the recorded sound, when played, a sensation of multidimensionality. However, these systems do not allow perceiving sensations of movement in up-down directions and recognizing sounds coming from a frontal area, in particular if the frontal area is lower than the listener.

SUMMARY OF THE INVENTION

It is therefore a feature of the present invention to provide a head support incorporating loudspeakers that makes it possible to obtain a reproduction of the sound, coming from high fidelity recordings, letting the user to perceive the direction of the sound source as far as possible corresponding to the direction of the sound source with respect to a microphone at the time of recording.

It is also a feature of the present invention to provide such a head support incorporating loudspeakers that allows the user to perceive a position of the sound source the closest possible to the position of the sound source at the time of recording with respect to a recording device.

It is also a feature of the present invention to provide such a head support incorporating loudspeakers that can provide an audio sensation of movement corresponding to a direction of movement of a recorded sound source in approaching or moving away with respect to a recording device.

It is another feature of the present invention to provide such a head support incorporating loudspeakers that allows a versatile utilization with respect to user's postures, without affecting a high fidelity listening of the multidimensional recording.

It is also a feature of the present invention to provide such a head support incorporating loudspeakers that, that both permits a multiplicity of postures of the user, and can be used in many application fields.

It is a further feature of the present invention to provide a head support incorporating loudspeakers that combines a multi-dimensional sound diffusion with a listening comfort.

It is a particular feature of the present invention to provide a head support incorporating loudspeakers that can be used by users with different head shapes and weight without affecting the multi-dimensional listening of the sound.

It is still a feature of the present invention to provide a system for distributing multi-dimensional acoustic effects that, when used in combination with the head support incorporating loudspeakers, can provide predetermined sequences of sounds that are perceived as coming from directions selected by the user or by assisting operators.

It is also a feature of the present invention to provide a system of binaural recording that allows, in a stereophonic listening context through the head support incorporating loudspeakers, according to the invention, or through other devices or reproduction systems, to perceive realistically the direction of the approaching/moving away movement of the sound source at the moment of recording.

It is another particular feature of the present invention to provide such a system of binaural recording that allows, in such a stereophonic listening context, an improvement of perception of the sound source if coming from up to down or vice-versa at the time of recording, and, in particular, the perception of sounds that are moving, at the moment of the recording, between a hypothetical listener and the ground.

It is another particular feature of the present invention to provide such a system of binaural recording that allows, in such a stereophonic listening context, an improvement of perception of the sound source if coming from the front, for example sounds that move in front of a hypothetical listener of the real sound when recording.

These and other features are achieved by a head support device incorporating loudspeakers, according to the invention, comprising:

- a rest element for the head of a user, made of a deformable material;
- a right lateral support element and a left lateral support element, located respectively at the right and left sides of the rest element, the right and left lateral support elements being connected to each other by the rest element, the right and left lateral support elements defining between each other a listening space and a longitudinal direction parallel to the lateral support elements;
- a right loudspeaker and a left loudspeaker mounted respectively to the right and left lateral support elements, the right and left loudspeakers having respective sound emission faces that face the listening space;
- the rest element providing a housing zone for a portion of the head configured to arrange the user with right and left ears oriented towards the right and left loudspeakers, the right and left ears creating a listening axis,
- the loudspeakers having each a woofer and a tweeter, the tweeter having an axis of symmetry, the loudspeakers mounted to the right and left lateral support elements so that the tweeters are oriented towards the listening space and have the axes of symmetry oriented with a predetermined angle of elevation, with respect to the listening axis, between a first elevation value substantially equal to zero, where the tweeters have the axes of symmetry aligned to each other and parallel to the listening axis, and a second elevation value substantially equal to 45° and where the tweeters have the axes of symmetry converging towards a point that is located higher than said listening axis.

In a possible embodiment, the tweeters have a center that is higher than the listening axis by a predetermined height, set between 0 and 5 cm.

In another possible embodiment, the tweeters have a center that is translated in the longitudinal direction, proximal to the user, by a predetermined distance, set between 0 and 10 cm.

In the first elevation value the tweeters are arranged so that when the user has the head resting on said housing zone the axes of symmetry coincide substantially with the listening axis.

In still another exemplary embodiment, the tweeters and the woofers are oriented in a predetermined direction, and the direction forms an angle with the horizontal plane set between 0° and 45°, preferably the inclination angle is set between 0° and 35°.

In still a further exemplary embodiment, the tweeters and the woofers are oriented in a predetermined direction, and the direction forms an angle with the vertical plane set between 0° and 10°.

This way, maintaining the tweeters in a position set between the above defined positions, the discrimination of the sound between woofers and tweeters, and the orientation of the axis of symmetry of the right and left tweeter with respect to the position of the user's head, allows the user, when the head is on the rest element, to appreciate all the multidimensional sound data as originally recorded.

In the positions where there is coincidence between axes of symmetry of the tweeters and listening axis, the symmetry of the higher frequency of the sounds with respect to the listening axis allows, when listening the audio recordings obtained by high fidelity binaural microphone, detection of the directionality of the sounds taken with the above described systems of recording. This way, the sound perception with respect to the directionality of sound source which is typical of the existing musical pillows is improved. For example, the listening of a sound that moves from up to down or vice-versa, or of a sound that moves frontally with respect to the listener can be improved. In fact, the position of the right and left tweeters coaxial to the listening axis avoids that the tweeters are located higher or lower than the listening axis, thus avoiding to confuse the listening if the sound source moves up to down or vice-versa. Similarly, the position of the right and left tweeters, coaxial to the listening axis, avoids that the tweeters are located further ahead or behind in the longitudinal direction of the listening axis, thus avoiding to confuse the listening if the sound source moves forward or backward with respect to the longitudinal direction. The asymmetrical position of the woofers instead, reproducing lower frequencies, allows a directional separation of the frequency spectrum between low and high, in order to define further the directional information.

In the positions where the two tweeters are oriented in such a way that converge above the listening axis of the user head, it is obtained an improved perception of the sounds that, at time of recording, came from a frontal direction with respect to the microphone system used to acquire it.

Advantageously, the distance between the right and left tweeters is set between 40 and 80 cm. This way, this distance allows forming a region of sound reproduction within the listening space that surround the head of the user, maximizing the fidelity of reproduction.

In an exemplary embodiment, the rest element provides a receiving recess, symmetric to the longitudinal direction, arranged to accommodate a portion of the user's head.

In particular, if the user rests in supine position, the receiving recess is configured to receive the portion of the user face comprising chin, mouth, nose and eyes, in a comfortable way providing a sensation of comfort to the user. In this case, maintaining one of the structures described above, the tweeters are exchanged with each other and the woofers are exchanged with each other. This way, the multi-dimensional effect on the user is kept notwithstanding its face is oriented in an opposite side.

Advantageously, the receiving recess for the face is made of a soft material and breathable, such as latex or another material designed to provide a adaptable to the face of the subject.

If the user rests on the rest element in a prone position, the receiving recess provides a centering region for the back of the head of the user.

In particular, the receiving recess can have a circular cross section, or a semicircular cross section, or other symmetric shape that assists centering the user's head.

Advantageously, if the user rests with the back of the head, a removable insert made of materials with different hardness from each other can be provided. The insert, besides making the support of the head more comfortable, assists centering of the head by providing a reference point for centering the back of the head of the user.

In a further exemplary embodiment of the invention, the rest element is provided with a deformable plastic micro perforated material and a wire for the connection to the right and left loudspeakers.

This way, the presence of the plastic deformable material allows, while the user rests, a correct position of the joints of shoulder and neck avoiding musculoskeletal diseases.

Advantageously, micro perforation has a size comprised between 1 and 5 mm. This way, this size of the holes allows keeping the head of the user always dry assisting the transpiration.

In an exemplary embodiment, it is provided an anti-skid sticker on the surface of the rest element. This way, the presence of the anti-skid sticker makes it possible to arrange the rest element for example on a headrest of an armchair, allowing use in many situations.

In an alternative exemplary embodiment of the invention, it is provided a connecting element for the left and right lateral support elements. In this exemplary embodiment, the presence of the connecting element allows to wear the head support on the head, with the advantage to use it while moving.

Preferably, the connecting element is flexible, thus fitting the user's head and in the meantime it provides a resiliency that avoids its detachment.

In a further exemplary embodiment of the invention, the right and left lateral support elements are connected to each other in order to form a structure that soundproofs the user inside the listening space. This way, the head support can be used, for example during rest or during travels.

Preferably, the right and left lateral support elements and the rest element are made of ergonomic materials selected from the group consisting of: latex, expanded polyurethane, etc.

In an exemplary embodiment of the invention it is provided the connection of the head support to such devices as tablet, smartphone, pc, cd/dvd reader or an Ethernet network for data streaming. A remote control can also be provided by which a user can interact with the above described devices.

In a further exemplary embodiment, sensors on the rest element are provided to interact with the user. Such sensors can measure the movement of the head of the user, as well as the pressure exerted by the user on the rest element. These sensors can detect the status of the user, identifying for example the movement of the head and of the eyes, allowing the interaction with the software contents of the head support. The sensors are also aimed at activating synchronized sound environments through recognition of opening and closing of pages of a book. The sensors can also be configured to interact with the environment light.

In a further exemplary embodiment, five loudspeakers are provided which are located in said listening space, in such a way to form a surround system. Channels can be connected via amplified audio signal or via HDMI. A device for audio transmission, such as a PC, provides audio contents.

In a possible exemplary embodiment, an articulated structure is arranged to support a mobile device, such as a tablet. This way, the user that rest on the rest element can adjust the articulated structure to its preference to maximize experience when using the tablet.

In a further exemplary embodiment of the invention, the rest element has a housing zone for the user's head oriented in a predetermined direction, and the direction forms an angle with the horizontal plane. This way, the inclination of the housing zone allows the user, when the head is on the rest element, to appreciate all the multidimensional sound information as originally recorded.

According to another aspect of the invention, a system of binaural recording of a sound source is provided, comprising:

- a dummy head arranged to provide a physic and acoustic barrier between two opposite right and left sides thereof,
- two auricles mounted to the two opposite right and left sides of the dummy head, wherein the auricles have a central channel defining a recess having an entry that faces outwards, and a cavity among a helix and a lobe,
- two lateral microphone capsules associated with said two auricles, said lateral microphone capsules configured for recording sounds coming from sound sources present in a recording environment, said lateral microphone capsules having a sound collection face, each of said lateral microphone capsules is located in said recess of said central channel of the respective auricle with said sound collection face that is arranged substantially at said entry and in said recess, said system of binaural recording having two further lateral microphone capsules mounted to said dummy head on the two opposite right and left sides thereof, and having a sound collection face oriented laterally to said dummy head, said two further lateral microphone capsules mounted at a distance from the auricles, in particular in a position different in a vertical direction with respect to said lateral microphone capsules mounted to the auricles, in particular above said auricles.

This way, the sound is collected at the entrance of the channel in the center of the auricle, and not after having crossed an artificial auditory channel as binaural microphone of prior art. This solution avoids distortion and rumbles of the original sound that would happen otherwise when the sound is propagated through the artificial auditory channel.

The fact that the sound collecting face is located in the recess of the auricle, allows the auricle, and in particular the helix of the auricle, to shield sounds such as the ones that come from behind or from above the head. This allows better discrimination of those sounds compared to the sounds coming from the lateral sides.

Furthermore, the presence of the two lateral microphone capsules adds, to sounds collected through the lateral microphone capsules located in the auricle and above defined, a full and direct perception of the sounds coming laterally. This way it is possible to perceive recorded sounds that move in up to down direction.

In an exemplary embodiment of the invention, two frontal microphone capsules are mounted to said dummy head, having a sound collection face oriented towards a frontal face of said dummy head, in particular said two sound collection faces of said two lateral microphone capsules, mounted to the auricles, are arranged at a predetermined first distance from each other and said frontal microphone capsules are arranged at a second distance from each other that is less than said first distance. In particular, the first distance is set between 15 and 13 cm and the second distance is set between 13 and 10 cm from the auricles, and, in particular, the helices of the two auricles are at a distance from each other set between 15 and 20 cm. In particular, the two frontal microphone capsules are arranged in a position h1 different in vertical direction from the lateral microphone capsules, and, in particular arranged from 1 to 3 cm higher or lower therefrom.

This way, with respect to the sounds collection obtained through the lateral microphone capsules above defined, it is obtained a sound collection coming from the frontal direction, simulating sonic sensations by the front part of the face of a person, and improving therefore the fidelity of sounds that come from a frontal direction.

Furthermore, while the lateral microphone capsules simulate the collection of sounds by the auricles of the human ear, the inner position of the frontal microphone capsules causes a sound collection carried out at an inner position. This effect is similar to the sound collection provided by the cochlea of the human ear, which is inner with respect to the auricles.

The auricles, and, in particular the helices of the two auricles, which in the human ear are the portions more lateral, are at a distance from each other set between 15 and 20 cm, in order to shield sounds coming from the top or from behind from sounds coming from the right and left sides.

In a possible exemplary embodiment, the two frontal microphone capsules are in a lower position in a vertical direction than the lateral microphone capsules.

The fact that the frontal microphone capsules are in a lower position than the lateral microphone capsules for a difference of height set between 1 and 3 cm, allows the listener to perceive in a more reliable way sounds moving in a vertical direction. In fact, the lateral microphone capsules perceive differently than the frontal one the intensity of sounds moving in up to down direction or vice versa. Such effect reproduces, like the human ear, the position of the cochlea which is lower than the auditory channel.

In a further exemplary embodiment of the invention, a partition wall is arranged between the two frontal microphone capsules. The partition wall is made of a material acoustically insulating, arranged to acoustically insulate the two frontal capsules.

This way, the presence of the partition wall provides an acoustic shield that makes it possible to each frontal capsule of distinguishing the sounds coming from the respective right and left sides.

According to another aspect of the invention, it is provided an audio product or an audio-visual product containing at least a part of audio recording obtained by a system of binaural recording as above defined.

According to a further aspect of the invention, it is provided a system for distributing multi-dimensional acoustic effects, comprising

- a head support incorporating loudspeakers, in particular as a preferred exemplary embodiment above defined;
- a memory unit containing a plurality of audio tracks, each audio track being acquired by a system of binaural recording associated with an object defining the encumbrance of a human body, each audio track of said plurality being associated with at least one predetermined body part at which a sound source has been arranged at the time of recording,
- a control unit configured to transmit said audio tracks to the head support incorporating loudspeakers;
- an input interface, connected to said control unit, and configured to graphically display a representation of said or each body part, and to allow selecting at least one body part;

said control unit configured in such a way that, when said or each body part, which is present in the interface, is selected, said control unit causes the loudspeakers of said support to reproduce at least one audio track associated with said at least one selected body part.

This way, using the system of binaural recording, a plurality of audio tracks is obtained, each responsive to sounds originated in a predetermined position with respect to the system of binaural recording. In particular, each position of the space is referred to a body part identified using an object arranged to simulating the encumbrance of a human body.

In particular, the user that rests their head on the support, through the listening of the audio tracks played by the loudspeakers of the support, receives a listening experience which allows appreciation of multidimensional acoustic effects of the recorded sound source, corresponding to the selected body part.

This way, the system can be used as instrument of rehabilitation, for example to stimulate the hearing skills of autistic patients or hearing impaired persons. For example, a therapist can decide the activation of different body areas that have to be identified by the patient, or that in any case further stimulate the patient.

BRIEF DESCRIPTION OF THE DRAWINGS

Further characteristic and/or advantages of the present invention will be made clearer with the following description of an exemplary embodiment thereof, exemplifying but not limitative, with reference to the attached drawings in which:

FIG. 42 shows, in a schematic top view, another exemplary embodiment of the system of binaural recording of FIG. 32 comprising two further lateral microphone capsules mounted to the dummy head, in particular the two further lateral microphone capsules are mounted in a position higher in a vertical direction with respect to the auricle and oriented laterally;

FIG. 43 shows, in a schematic front view, another exemplary embodiment of the system of binaural recording of FIG. 32 with four lateral microphone capsules and three front microphone capsules;

DESCRIPTION OF SOME PREFERRED EXEMPLARY EMBODIMENTS

Figure 1A:
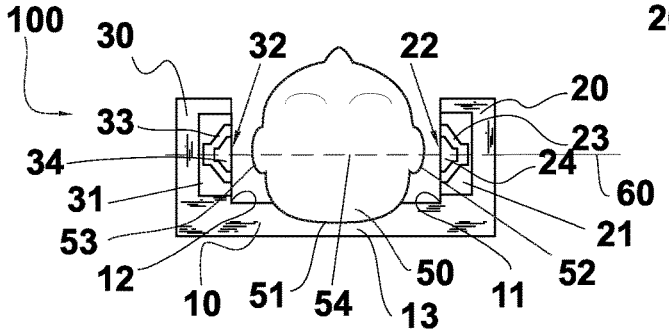
FIG. 1A shows, in a schematic back view, a head support incorporating loudspeakers, according to the invention, with two loudspeakers oriented with a predetermined first angle of elevation with respect to the listening axis and with the respective tweeters having the axes of symmetry aligned to each other and parallel to the listening axis.
Figure 1B:
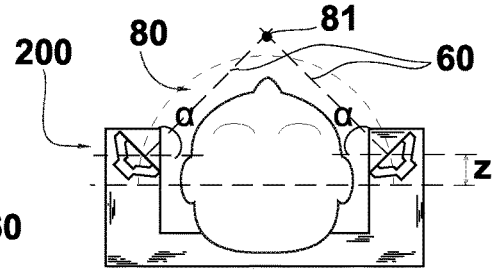
FIG. 1B shows, in a schematic back view, the head support incorporating loudspeakers, according to the invention, with two loudspeakers oriented with a predetermined second angle of elevation and with the respective tweeters having the axes of symmetry converging towards a point that is located upper with respect to the listening axis.

With reference to FIGS. 1A, 1B, 2A, 3A, according to the invention, a head support 100 incorporating loudspeakers comprises a rest element 10 for the head 50 of a user, two right 20 and left 30 lateral support elements, which are located respectively at the right 11 and left 12 sides of rest element 10.

A right loudspeaker 21 and a left loudspeaker 31 are mounted respectively to the right 20 and left 30 lateral support elements. The lateral support elements have respective sound emission faces 22, 32 that face towards a listening space 80. Rest element 10 provides a rest zone 13 for a portion 51 of the head.

A listening space 80 is defined between the two right 20 and left 30 support elements (as shown only in FIG. 1B, but similarly present in the exemplary embodiment of FIG. 1A) and a longitudinal direction 15 parallel to support elements 20, 30. Each of the two right 21 and left 31 loudspeakers has a woofer 23, 33 and a tweeter 24, 34. The tweeters have an axis of symmetry 60.

A housing 13 is provided for a portion 51 of the head, configured to position the user's head with right and left ears 52, 53 oriented towards the right and left loudspeakers 21, 31. The right and left ears of the user create a listening axis 54, so that the axes of symmetry 60 of the tweeters 24, 34 are oriented with a predetermined angle of elevation a with respect to the listening axis 54 between a first elevation value substantially equal to zero and a second elevation value substantially equal to 45°. In the first case the tweeters 24, 34 have the respective axes of symmetry 60 aligned to each other and parallel to the listening axis, in the second case the tweeters 24, 34 have the axes of symmetry converging towards a point that is located higher than the listening axis 54.

Figure 2A:
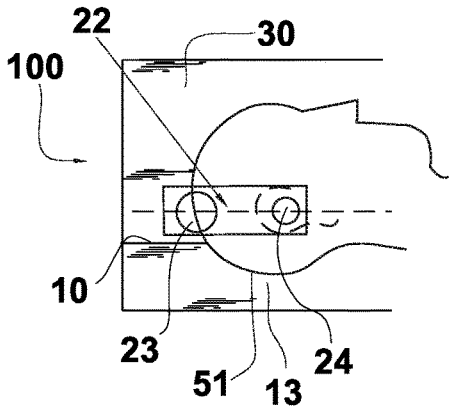
FIG. 2A shows, in a schematic side view, the support of FIG. 1A.
Figure 2B:
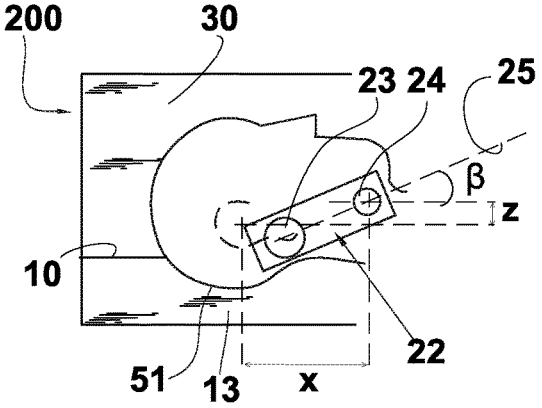
FIG. 2B shows, in a schematic side view, the support of FIG. 1B.

With reference to FIG. 2B, in a possible exemplary embodiment of the head support 100 incorporating loudspeakers, the tweeters 24 and 34 have a center that is higher than the listening axis for a predetermined height z set between 0 and 5 cm.

Tweeters 24 and 34 and woofers 23, 33 are arranged oriented in a predetermined direction at an angle in a horizontal plane by a predetermined inclination angle β set between 0° and 45°, preferably the inclination angle is set between 0° and 35°.

Furthermore, the tweeters 24, 34 have a respective center that is translated, along the longitudinal direction, proximally with respect to said user for a predetermined distance x set between 0 and 10 cm.

Figure 3A:
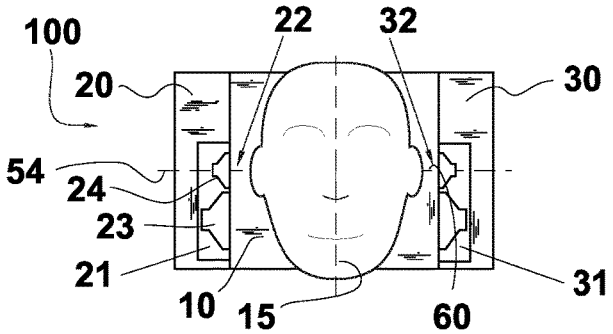
FIG. 3A shows, in a schematic top view, the support of FIG. 1A.
Figure 3B:
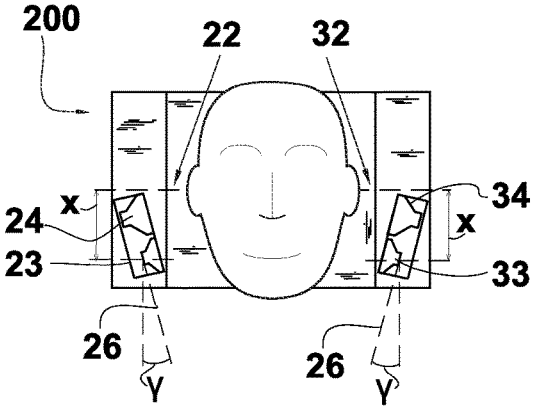
FIG. 3B shows, in a schematic top view, the support of FIG. 1B.

In a further exemplary embodiment (FIG. 3B), tweeters 24, 34 and woofers 23, 33 are arranged in a predetermined direction 26 oriented in a vertical plane by a predetermined angle of orientation γ set between 0° and 10°.

Figure 4:
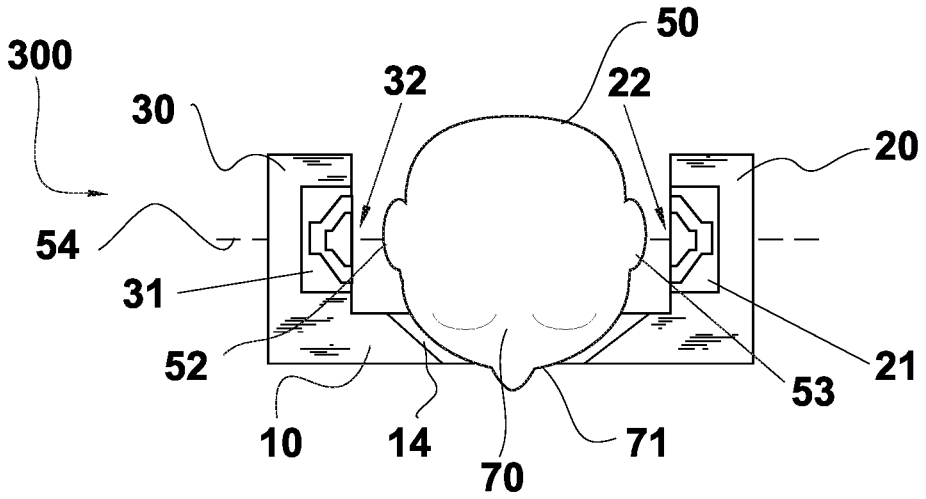
FIG. 4 shows, in a schematic front view, an exemplary embodiment of the head support incorporating loudspeakers of FIG. 1A, with a receiving recess for a portion of the face of the user.

With reference to FIG. 4, an exemplary embodiment 300 of the head support, which has the same reference numbers of FIGS. 1A,1B,2A,2B,3A,3B, comprises a receiving recess 14 arranged to receive a portion 71 of the face 70 of the user. In this case, maintaining one of the structures above described, the tweeters 24, 34 are exchanged with each other and the woofers 23, 33 are exchanged with each other. This way, the multidimensional effect on the user is kept, notwithstanding its face is oriented in an opposite side.

Figure 5:
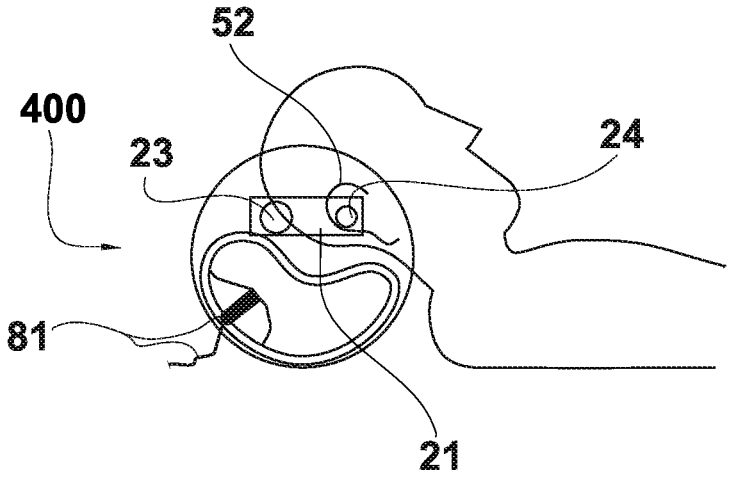
FIGS. 5, 6, 7 and 8 show respectively, a lateral cross section, a back view, a top view, and a lateral view of an exemplary embodiment of the support of FIG. 1A.

With reference to FIG. 5, in an exemplary embodiment 400 of the head support, the rest element can have a cylindrical shape, leaving unchanged the structures and the effects indicated as reference to FIGS. 1A,1B,2A,2B,3A,3B. In this case, an exemplary embodiment of the head support comprises an audio connecting element 81 (which can be fixed without stresses by a skilled person even at the structures previously described).

Figure 6:
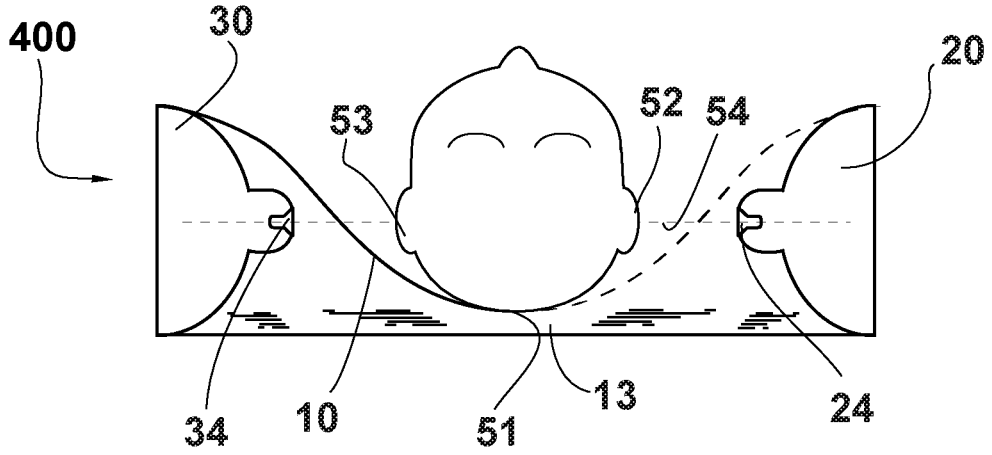
Figure 7:
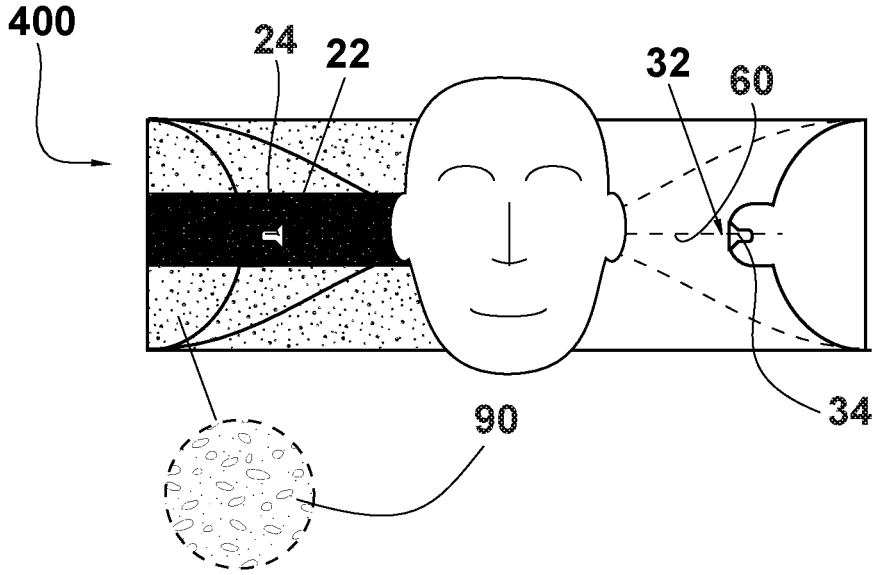
Figure 8:
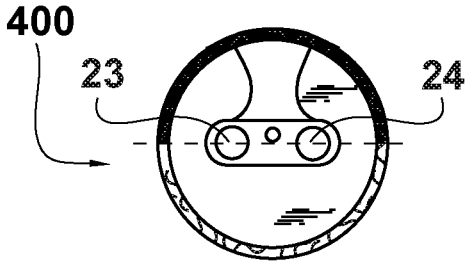

With reference to FIGS. 6 to 8, leaving unchanged the structures and effects indicated as reference to FIGS. 1A,1B, 2A,2B,3A,3B, a further exemplary embodiment 400 of the head support is shown, comprising a plastic deformable cover 90 for the rest element. The cover is made of a micro perforated material having a plurality of holes of size comprised between 1 and 5 mm.

Figure 9:
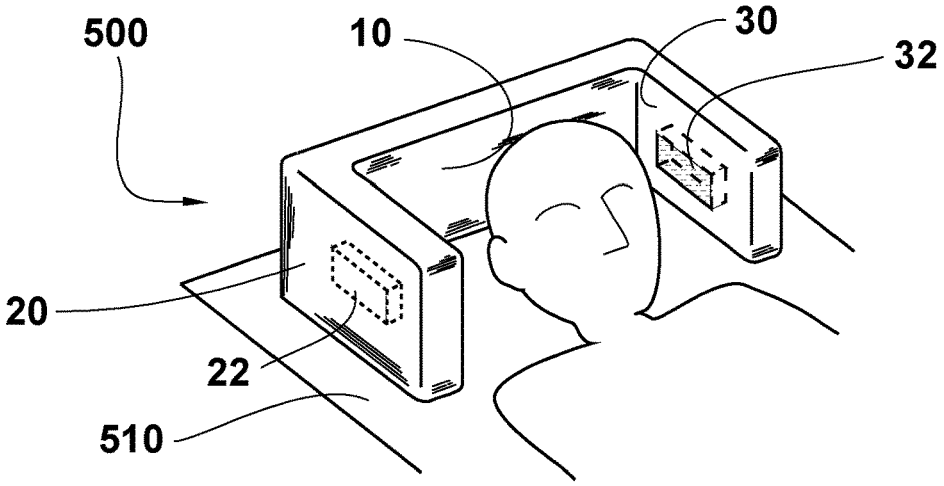
FIGS. 9, 10 and 11 show respectively, a perspective view, a cross section view and a further perspective view of an exemplary embodiment of the head support of FIG. 1A.
Figure 10:
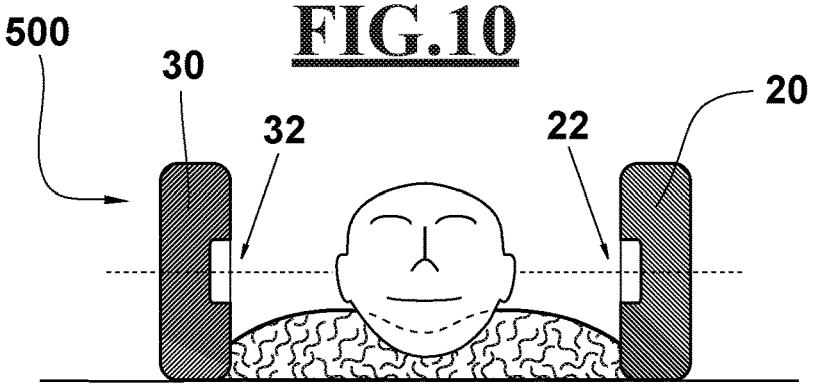
Figure 11:
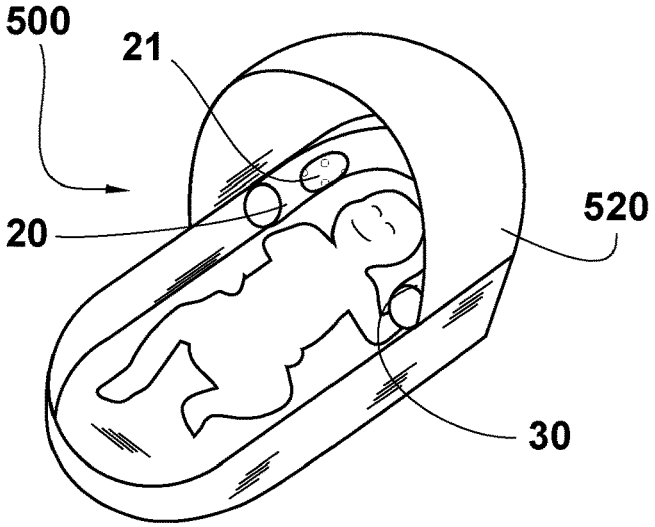

With reference to FIGS. 9 to 11, leaving unchanged the structures and effects indicated as reference to FIGS. 1A,1B, 2A,2B,3A,3B, an exemplary embodiment 500 of the head support comprises a rest element 10 on the frontal part of the head, that faces on the parietal surface of the user. Exemplifying, FIG. 11 shows a head support on a cradle for babies.

Figure 12:
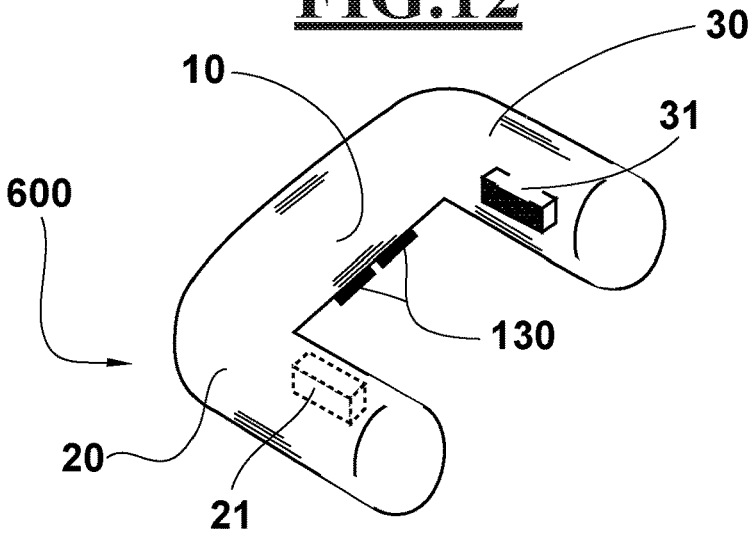
FIGS. 12, 13 and 14 show respectively a perspective view, a side view, and a top view of a further exemplary embodiment of the support of FIG. 1A, having an anti-skid sticker for the placement of the support on chairs and armchairs.
Figure 13:
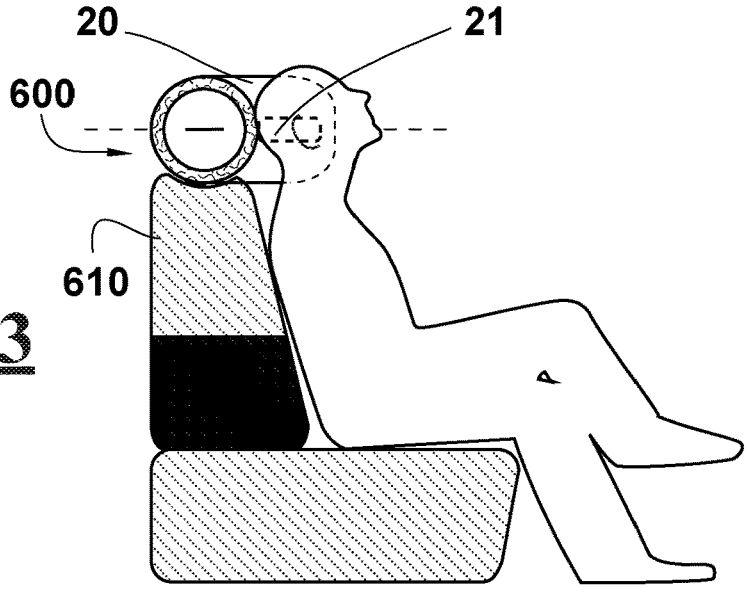
Figure 14:
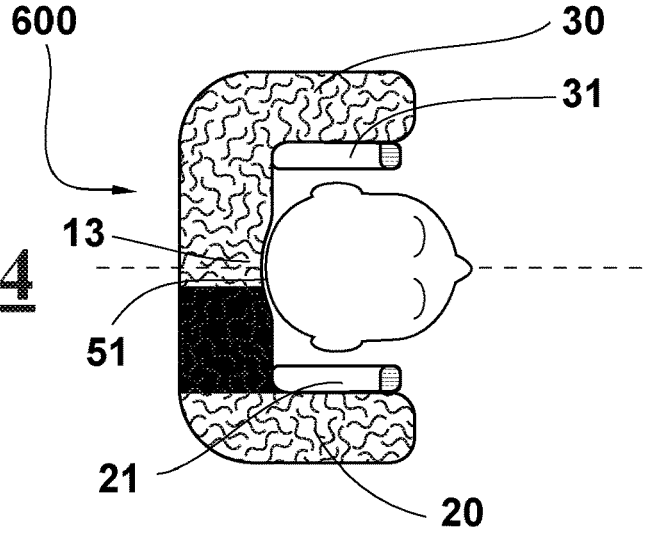

With reference to FIGS. 12 to 14, leaving unchanged the structures and effects indicated as reference to FIGS. 1A,1B, 2A,2B,3A,3B, an exemplary embodiment 600 of the head support comprises an anti-skid sticker 130 arranged on a portion of surface of the rest element. The presence of the anti-skid sticker 130 allows to mount the head support, for example, to a sofa or to an armchair 610.

Figure 15:
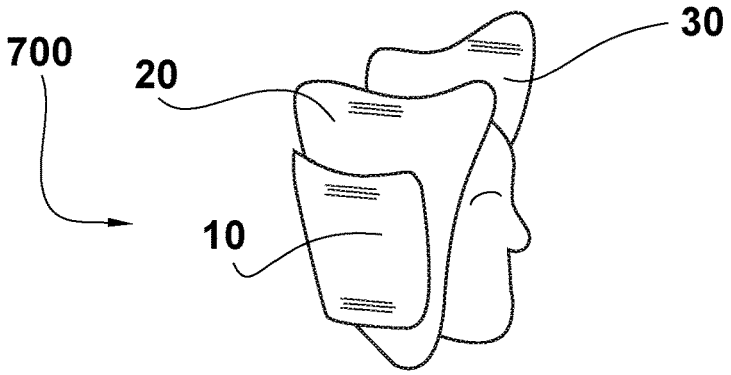
FIGS. 15, 16 and 17 show respectively, a perspective view, a top view, and a lateral cross section of a further exemplary embodiment of the support of FIG. 1A, comprising a connecting element between the two left and right lateral support elements.
Figure 16:
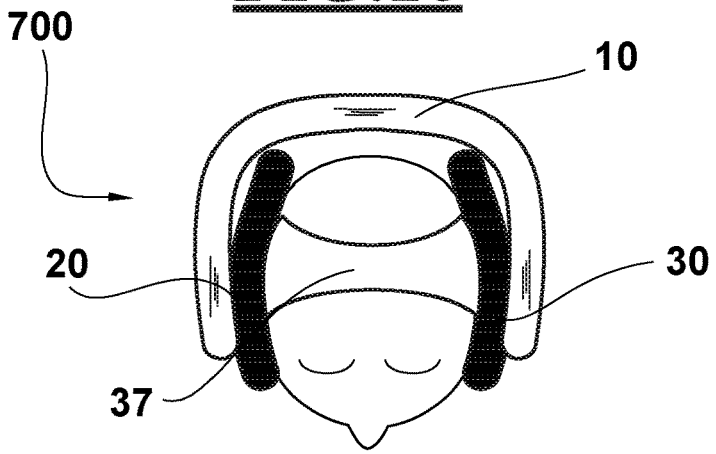
Figure 17:
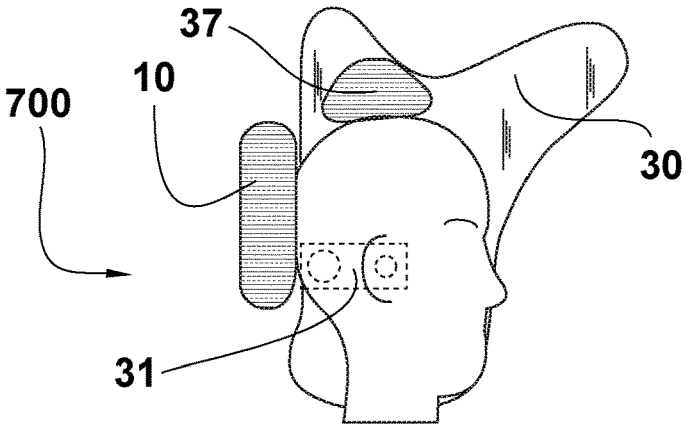

With reference to FIGS. 15 to 17, leaving unchanged the structures and effects indicated as reference to FIGS. 1A,1B, 2A,2B,3A,3B, an exemplary embodiment 700 of the head support comprises a connecting element 37 for the left 30 and right 20 lateral support elements. For example, the connecting element 37 can be made of a sound-transparent material which assists the user in wearing the support whilst maintaining the multi-dimensional effects of the sound.

Figure 18:
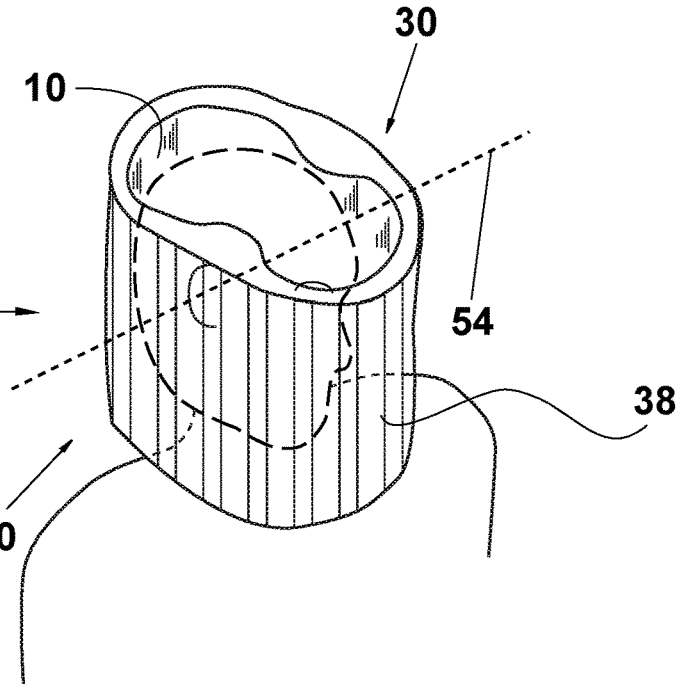
FIGS. 18, 19 and 20 show respectively, a perspective view, a front cross section, and a lateral cross section of a further exemplary embodiment of the support of FIG. 1A.
Figure 19:
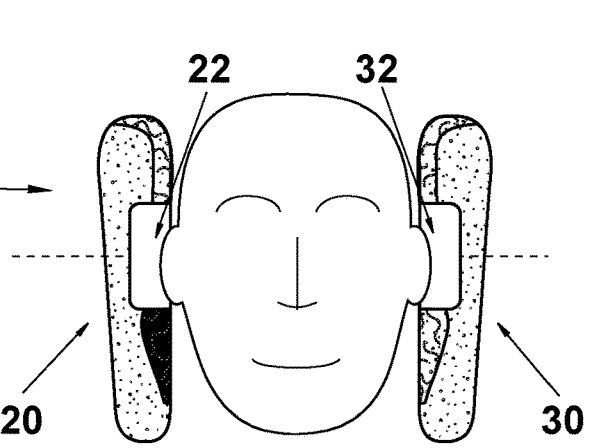
Figure 20:
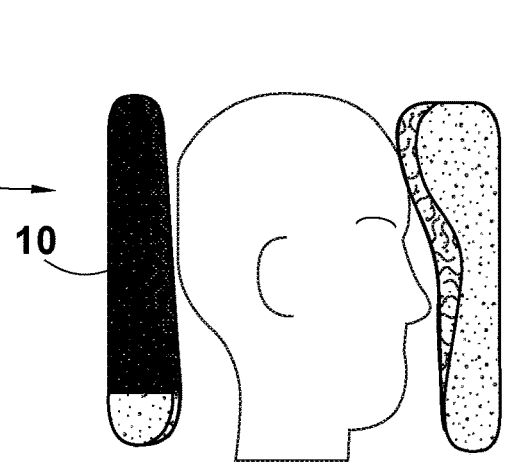

With reference to FIGS. 18 to 20, leaving unchanged the structures and effects indicated as reference to FIGS. 1A,1B, 2A,2B,3A,3B, an exemplary embodiment 800 of the head support, comprises a connecting element 38 which joins the two left and right support elements and can be worn, covering the face of the subject to provide an improved listening experience.

Figure 21:
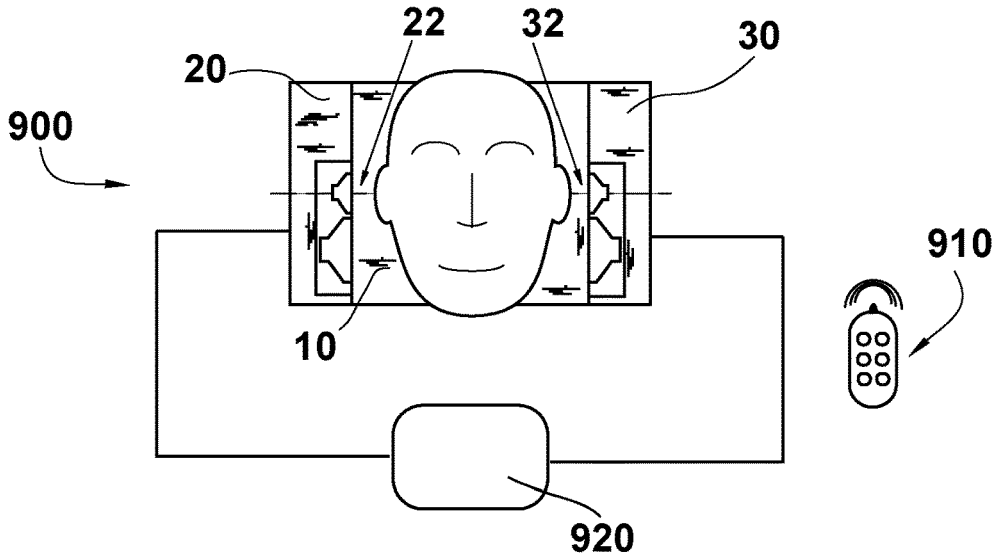
FIG. 21 shows, in a schematic top view, an exemplary embodiment of the head support incorporating loudspeakers of FIG. 1A, comprising an audio/video external unit.

With reference to FIG. 21, leaving unchanged the structures and effects indicated as reference to FIGS. 1A,1B,2A, 2B,3A,3B, an exemplary embodiment 900 of the head support, comprises multimedia devices 920 arranged to be connected to the support and actuated by a control device 910, for example a remote control that can be operated by the user.

Figure 22:
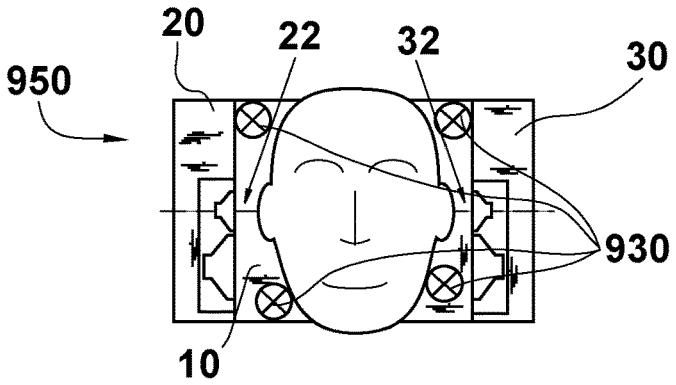
FIG. 22 shows, in a schematic top view, an exemplary embodiment of the head support incorporating loudspeakers of FIG. 1A, wherein a sensor system is provided on the rest element.

With reference to FIG. 22, leaving unchanged the structures and effects indicated as reference to FIGS. 1A,1B,2A, 2B,3A,3B, a further exemplary embodiment 950 of the head support, comprises a plurality of sensors 930 located on rest element 10 and arranged to interact with the user.

Figure 23:
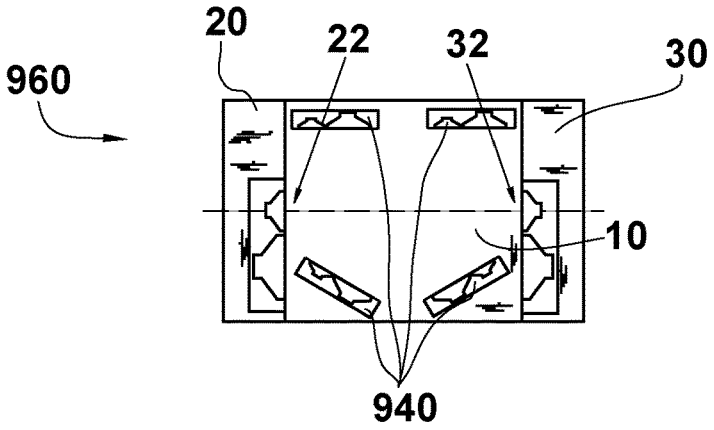
FIG. 23 shows, in a schematic top view, an exemplary embodiment of the head support incorporating loudspeakers of FIG. 1A, wherein three further loudspeakers are provided.

With reference to FIG. 23, leaving unchanged the structures and effects indicated as reference to FIGS. 1A,1B,2A, 2B,3A,3B, an exemplary embodiment 960 of the head support, comprises further four loudspeakers 940 mounted to rest element 10.

Figure 24:
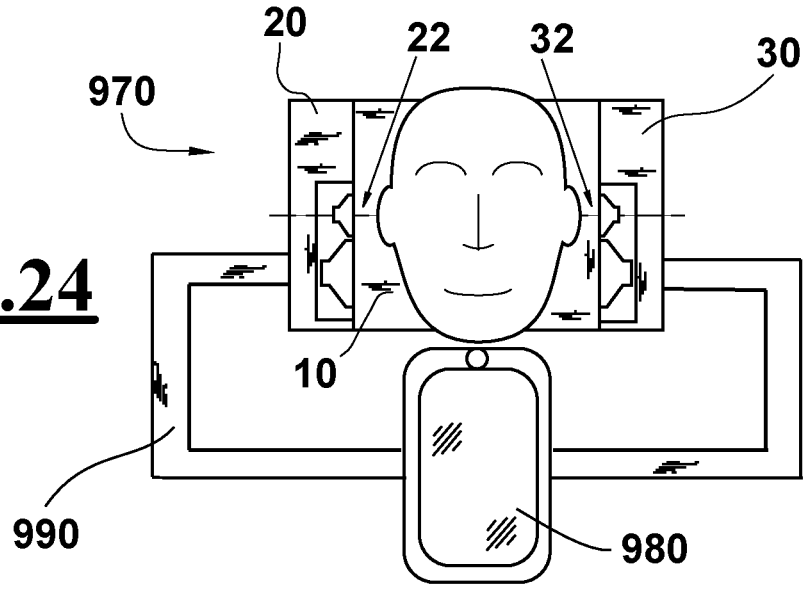
FIG. 24 shows, in a schematic top view, an exemplary embodiment of the head support incorporating loudspeakers of FIG. 1A, wherein an articulated structure is arranged to support a mobile device.

With reference to FIG. 24, leaving unchanged the structures and effects indicated as reference to FIGS. 1A,1B,2A, 2B,3A,3B, an exemplary embodiment 970 of the support, comprises an articulated structure 990 arranged to support a mobile device 980, such as a tablet.

Figure 25:
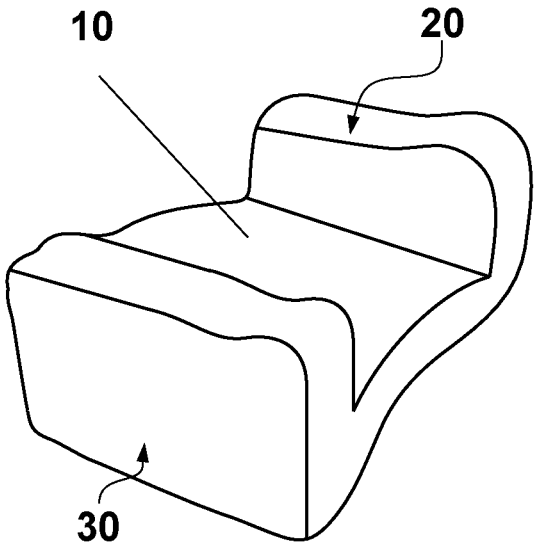
FIG. 25 shows a perspective view of a possible exemplary embodiment of the head support of FIG. 1A.

FIG. 25 shows a perspective view of an exemplary embodiment of the head support made of a deformable material with a leather protective coating.

Figure 26:
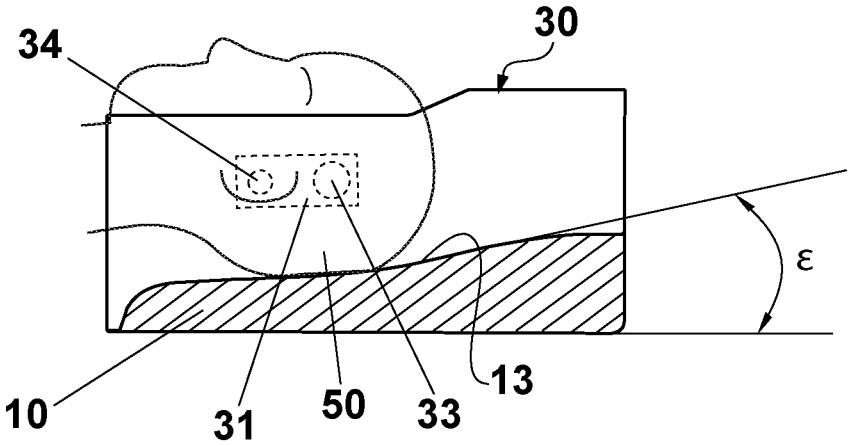
FIG. 26 shows a cross sectional view of the head support incorporating loudspeakers of FIG. 1A, wherein the rest element has a housing at an angle in a horizontal plane.

FIG. 26 shows a cross section of a further exemplary embodiment of the audio playing head support of FIG. 1A, wherein rest element 10 has a housing 13 for the head 50 of the user at an angle in a horizontal plane by an angle E.

Figure 27:
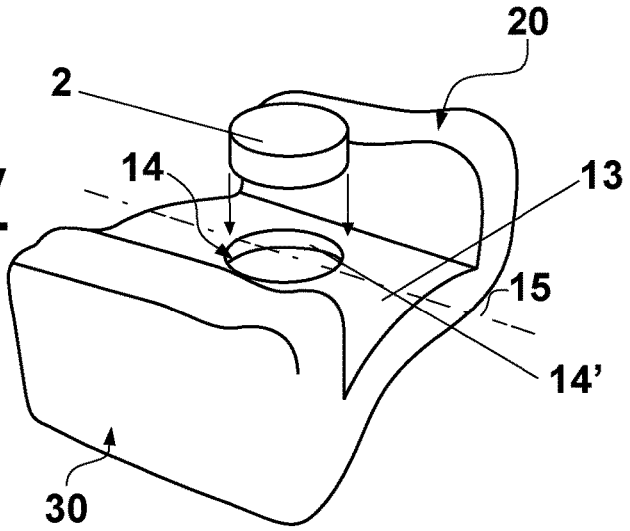
FIG. 27 shows a perspective view of a first exemplary embodiment of the head support incorporating loudspeakers of FIG. 1A, comprising a receiving recess for a head portion of the user.

FIG. 27 shows an exemplary embodiment of the audio playing head support of FIG. 1A, where the receiving recess 14 for a head portion of the user has a circular cross section, symmetric with respect to the longitudinal direction 15, arranged to receive an insert 2 with circular cross section. The insert 2 can be made of a material having a different hardness with respect to the material used for the rest element, in order to realize a more comfortable support for the head 50. When housing the insert 2 in the receiving house 14, the presence of the edge 14' on the receiving house 14 has the further advantage to provide a reference point to center the head 50 in a position of optimal listening.

Figure 28:
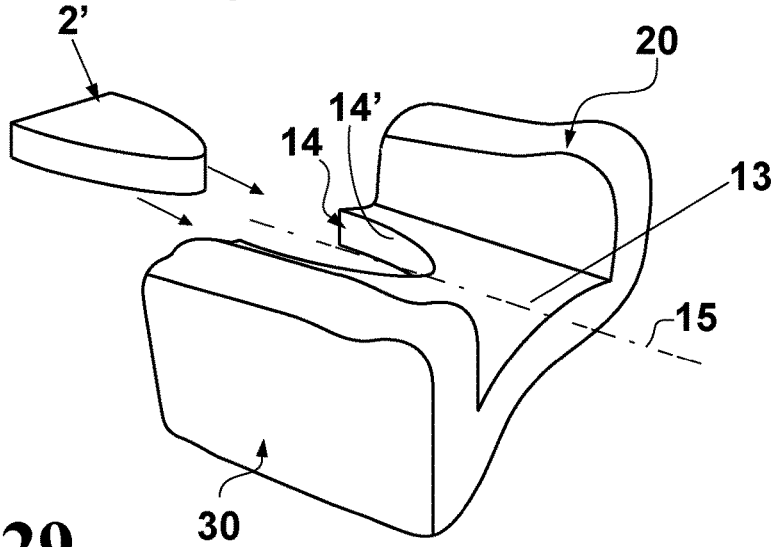
FIG. 28 shows a perspective view of a second exemplary embodiment of the head support incorporating loudspeakers of FIG. 1A, comprising a receiving recess for a head portion of the user.

FIG. 28 shows a further exemplary embodiment of the support of FIG. 27 wherein the receiving house 14 is a semicircular slot symmetric to the longitudinal direction 15, configured to receive an insert 2 having the same shape. Even in this case, as in the case of the previous figure, the edge 14' of the slot provides a reference point to center the head of the user.

Figure 29:
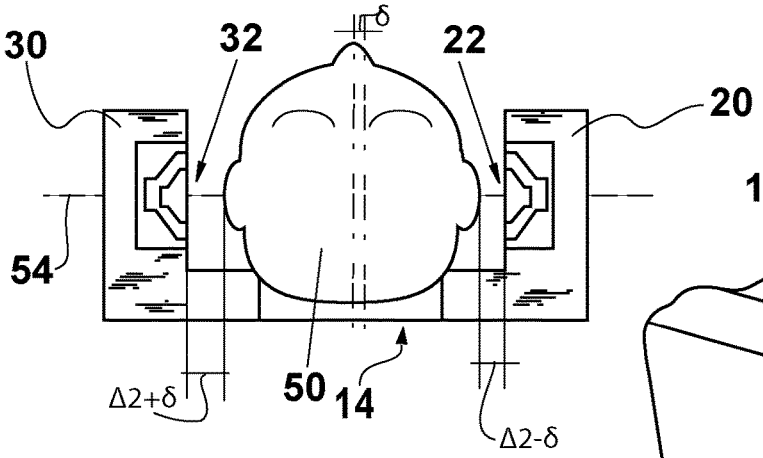
FIG. 29 shows, in a schematic view, the effect of head centering obtained by the exemplary embodiments described in FIGS. 27, 28.

In FIG. 29, a schematic view of a support is given, similar to that of FIG. 1A, relative to the effect of head centering by recess 14 and of an edge 14'. In particular, if the user is positioned with an error of eccentricity 6 with respect to the longitudinal direction 15, an altered listening on both sides would be perceived depending on the eccentricity 6.

Figure 30:
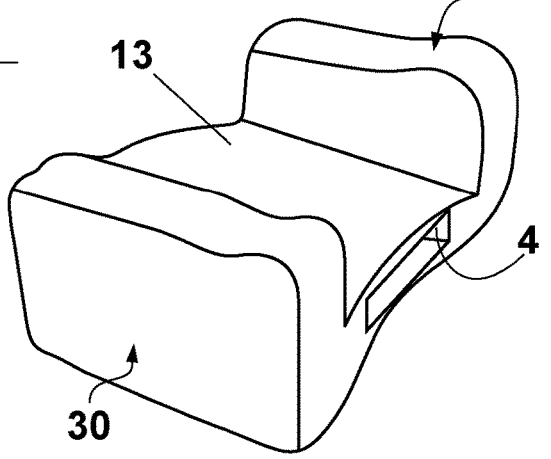
FIG. 30 shows, in a perspective view, an exemplary embodiment of the head support incorporating loudspeakers of FIG. 1A, comprising an amplifier housing.

FIG. 30 shows a perspective view of an exemplary embodiment of the support of FIG. 1A, comprising an amplifier housing 4.

Figure 31:
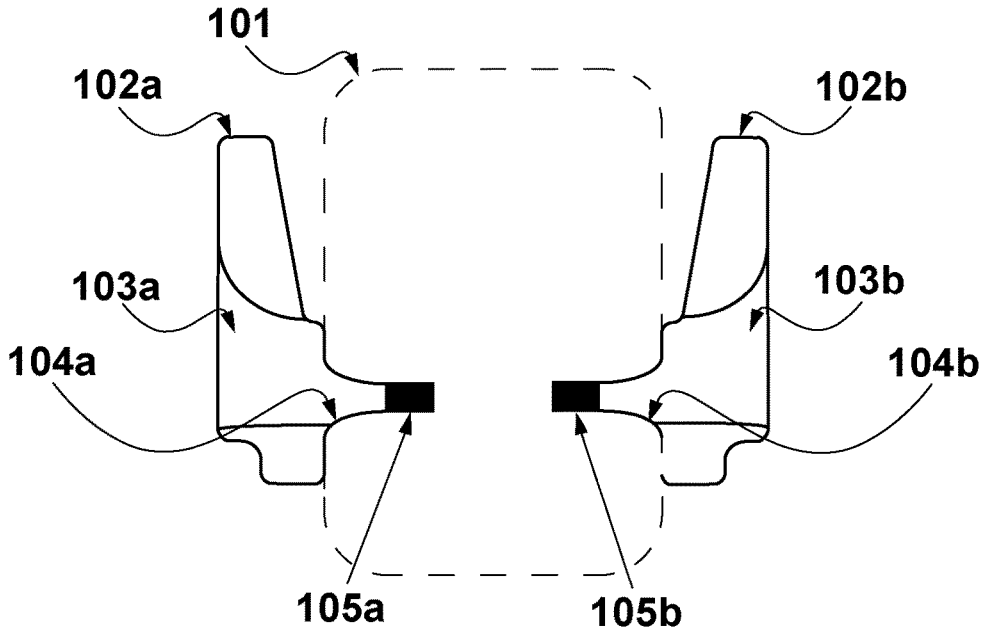
FIG. 31 shows a schematic view of a prior art device of binaural recording, with two lateral microphone capsules placed into left and right auditory channels.
Figure 32:
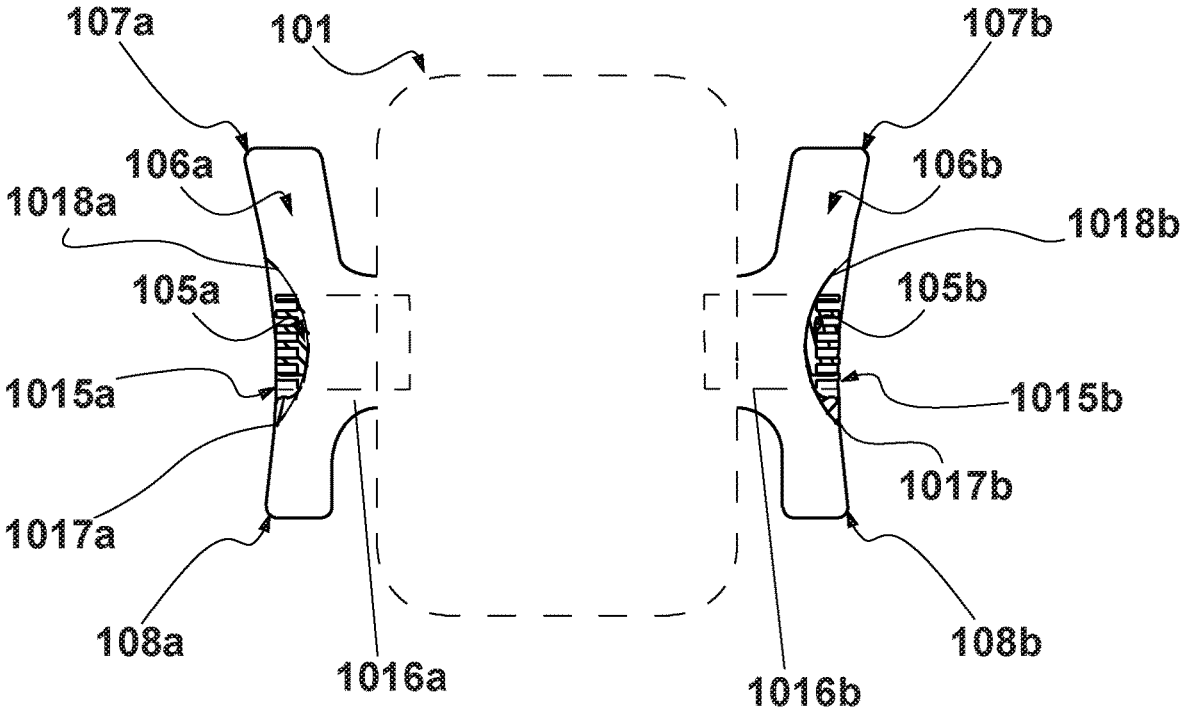
FIG. 32 shows a front view of a system of binaural recording, according to the invention, with two microphone capsules arranged flush with artificial auricles.
Figure 33:
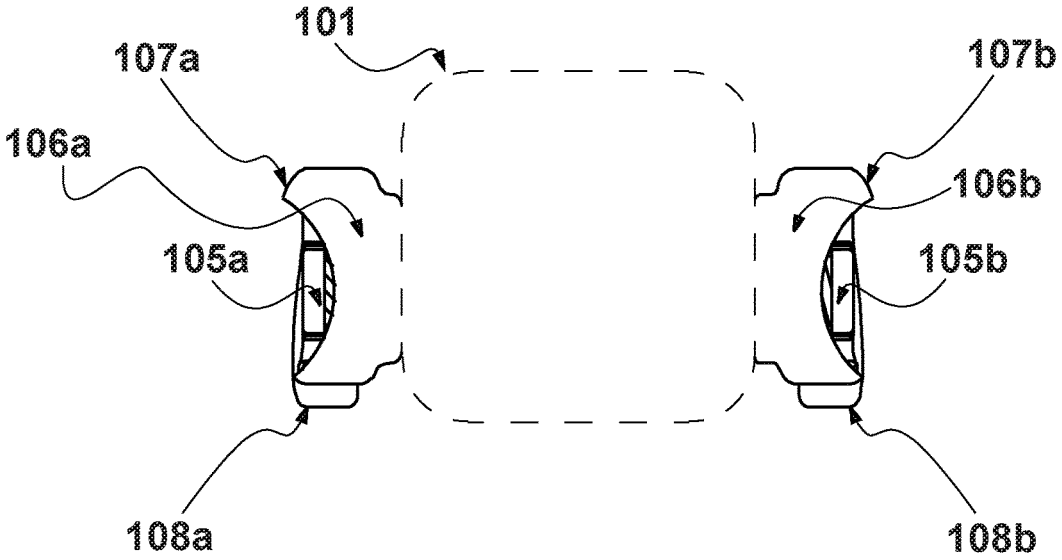
FIG. 33 shows a top view of the system of FIG. 32.
Figure 34:
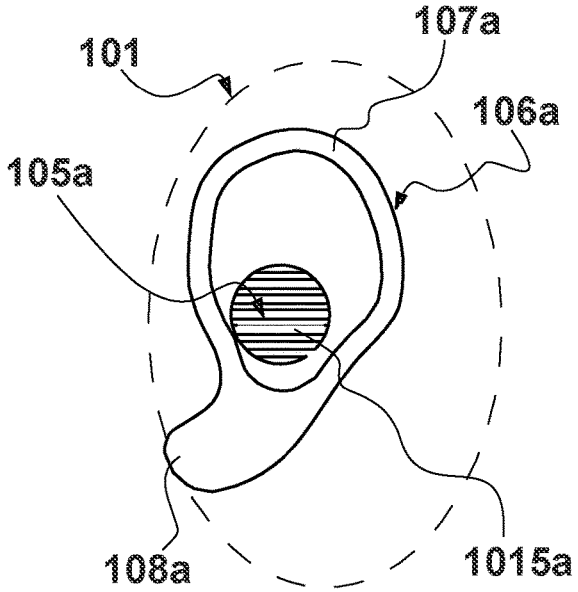
FIGS. 34 and 35 show, a right side view and a left side view of the system of FIG. 32.
Figure 35:
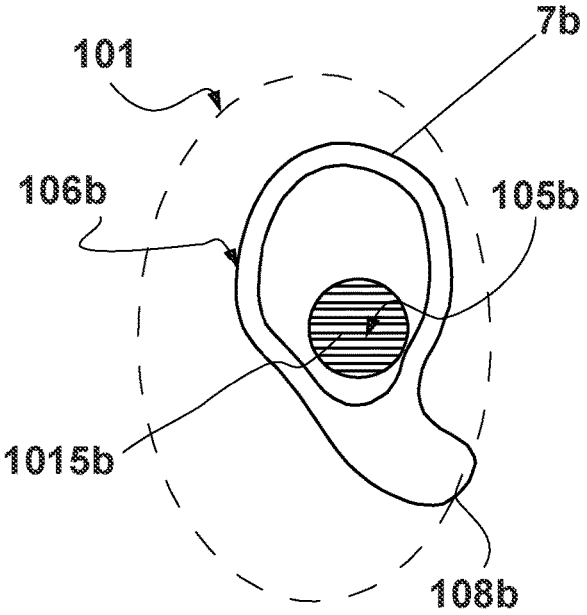

FIG. 31 schematically shows a prior art system of binaural recording having a so called "dummy head" 101, and shape similar to the human head. The "dummy head" can be simply a body configured as an insulating barrier made for example of polyurethane foam. The dummy head 101 have two ears 102*a*, 102*b*, each of which have a listening channel 103*a*, 103*b* to emulate the human listening channel, and have a channel or recess 104, to emulate the auditory channel. Two lateral microphone capsules 105*a*, 105*b* are arranged at one end of the listening channel 103*a*, 103*b*, opposite to the ears 102*a*, 102*b* and arranged to correspond to the anatomical position of the human eardrum.

With reference to FIGS. 32 to 35, an improved system of binaural recording comprises, similarly to the prior art, a dummy head 101, arranged to provide a physic and acoustic barrier between two opposite right and left auricles 106*a*, 106*b*.

According to the invention, the auricles 106*a*, 106*b* are respectively configured to receive two lateral microphone capsules 105*a*, 105*b* so that they have a sound collection face 1015*a*, 1015*b* oriented laterally. The auricles 106*a*, 106*b* have a listening channel, not emulating the human ear, represented by a recess 1017*a*, 1017*b* defined between a helix 107*a*, 107*b* and a lobe 108*a*, 108*b*.

Each lateral microphone capsule 105*a*, 105*b* is located on the recess 1017*a*, 1017*b* with the sound collection face 1015*a*, 1015*b* that is inside the recess at the entrance 1018*a*, 1018*b* of the recess 1017*a*, 1017*b*.

This way, the sound is collected directly at the entrance 1018*a*, 1018*b* of the recess 1017*a*, 1017*b* that represents the listening channel and is located at the center of the auricle, and not after having crossed an artificial listening channel as the binaural microphone of the prior art of FIG. 31. This avoids distortions and rumbles of the sound source that occurs during the crossing of the artificial listening channel of prior art.

The fact that the sound collection face 1015*a*, 1015*b* is located in the recess 1017*a*, 1017*b* allows auricles 106*a*, 106*b* and, in particular to the helixes 107*a*, 107*b* of the auricles, to perform an acoustic shielding and at the same time to collect for example sounds that come from behind or from above with respect to the head. This way, it is possible to discriminate better, like the human ear, sounds coming from a sound source positioned laterally, i.e. by the respective right or left sides, from sounds that come from behind or from the above.

The auricles, and in particular the helixes 107*a*, 107*b* of the two auricles 106*a*, 106*b*, that in the human ear are the more protruding portions, are preferably at a distance from each other set between 15 and 20 cm, in order to protrude more than the collecting faces 1015*a* and 1015*b* and to shield in part sounds that are from the above or from behind with respect to sounds that come from the right and left sides.

Figure 36:
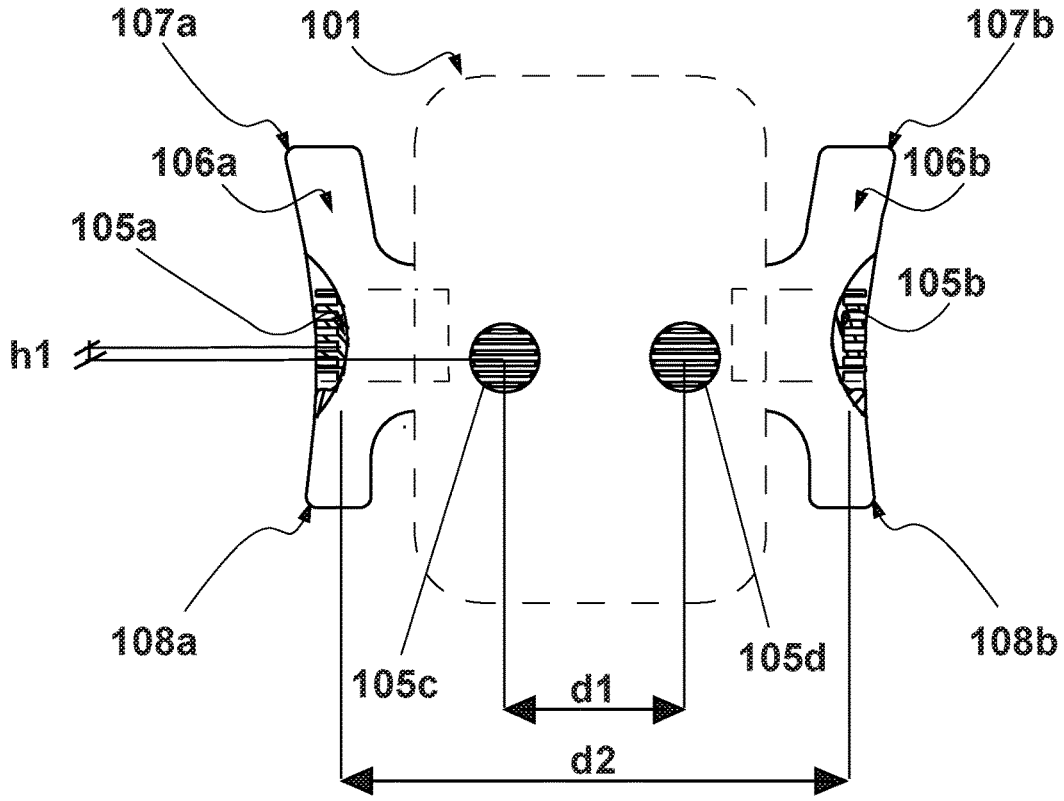
FIG. 36 shows a front view of an exemplary embodiment of the system of binaural recording of FIG. 32 with two further frontal microphone capsules mounted to the dummy head.
Figure 37:
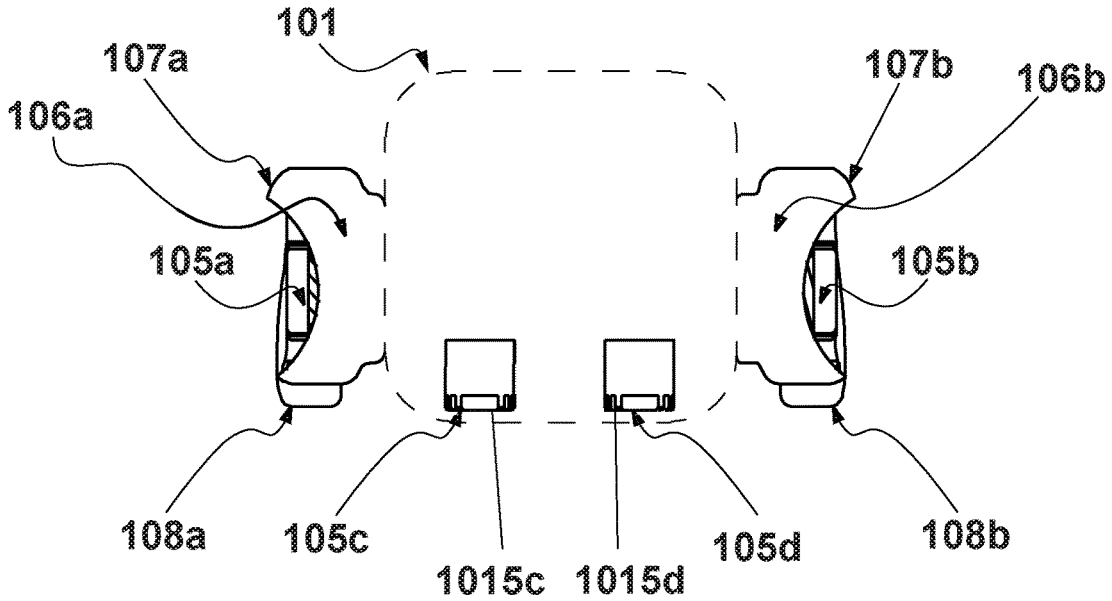
FIG. 37 shows a top view of the system of binaural recording of FIG. 36.

With reference to FIGS. 36 and 37, an exemplary embodiment of the improved system of binaural recording comprises, in addition to the two lateral microphone capsules 105*a*, 105*b* located in accordance to what described in the FIGS. 32-35, also two frontal microphone capsules 105*c*, 105*d*, which are located frontally to the dummy head 101.

This way, to the sound collection obtained through the lateral microphone capsules 105*a*, 105*b* defined above, also a sound collection coming from the frontal direction is added, simulating audio sensations from the front part of the face of a person, and improving therefore the fidelity with respect to sounds coming from a frontal direction.

The two frontal microphone capsules front 105*c*, 105*d* can have a linear distance d1 to each other less than the linear distance d2 between the two lateral microphone capsules (d1<d2). In particular, the distance d2 between the collecting faces 1015*a* and 1015*b* of the frontal microphone capsules 105*a*, 105*b* is set between 15 and 13 cm, and the distance d1 between the frontal microphone capsules 105*c*, 105*d* is set between 13 and 10 cm.

This way, whereas the lateral microphone capsules 105*a*, 105*b* simulate the listening collection by the auricles of the human ear, the inner position of the frontal microphone capsules 105*c*, 105*d* causes a sound collection which emulates the cochlea of human ear, which is inner within respect the auricles.

In a possible exemplary embodiment, the two frontal microphone capsules 105*c*, 105*d* are located at a difference in height 0<h<h1 from the two lateral microphone capsules, in a lower position in a vertical direction with respect to the lateral microphone capsules, as shown in FIG. 36, or also in a higher position, not shown.

The difference of position in height of the frontal microphone capsules front 105*c*, 105*d* with respect to the lateral microphone capsules 105*a*, 105*b* aids to reproduce in a more realistic way the effect on the listener of sounds in movement in a vertical direction. In fact, the lateral microphone capsules 105*a*, 105*b* would collect in a different way from the frontal capsules 105*c*, 105*d* the intensity of sounds moving up to down or vice-versa. In particular, the frontal microphone capsules are lower or higher than the lateral microphone capsules for a difference in height set between 1 and 3 cm. This emulates the different position in height, in the human ear, of the cochlea with respect to the auditory channel.

The lateral microphone capsules 105*a*, 105*b* can be configured for recording at a predetermined first intensity, and the frontal microphone capsules 105*c*, 105*d* can be configured for recording at a predetermined second intensity that is less than the first intensity for a difference in gain in dB set between 1 and 20 db. This way, a reduction of vestibular sensation is emulated, like in human ear, for sounds moving from a frontal direction that cross the skeletal parts of the face, with respect to sounds heard directly through the eardrum.

Furthermore, the two frontal microphone capsules 105*c*, 105*d* can be configured for recording at an opposite phase from the lateral microphone capsules 105*a*, 105*b*. Alternatively, the two frontal microphone capsules 105*c*, 105*d* can be configured for recording with respect to the lateral microphone capsules 105*a*, 105*b* with a phase shift of 20/40 samples.

Figure 38:
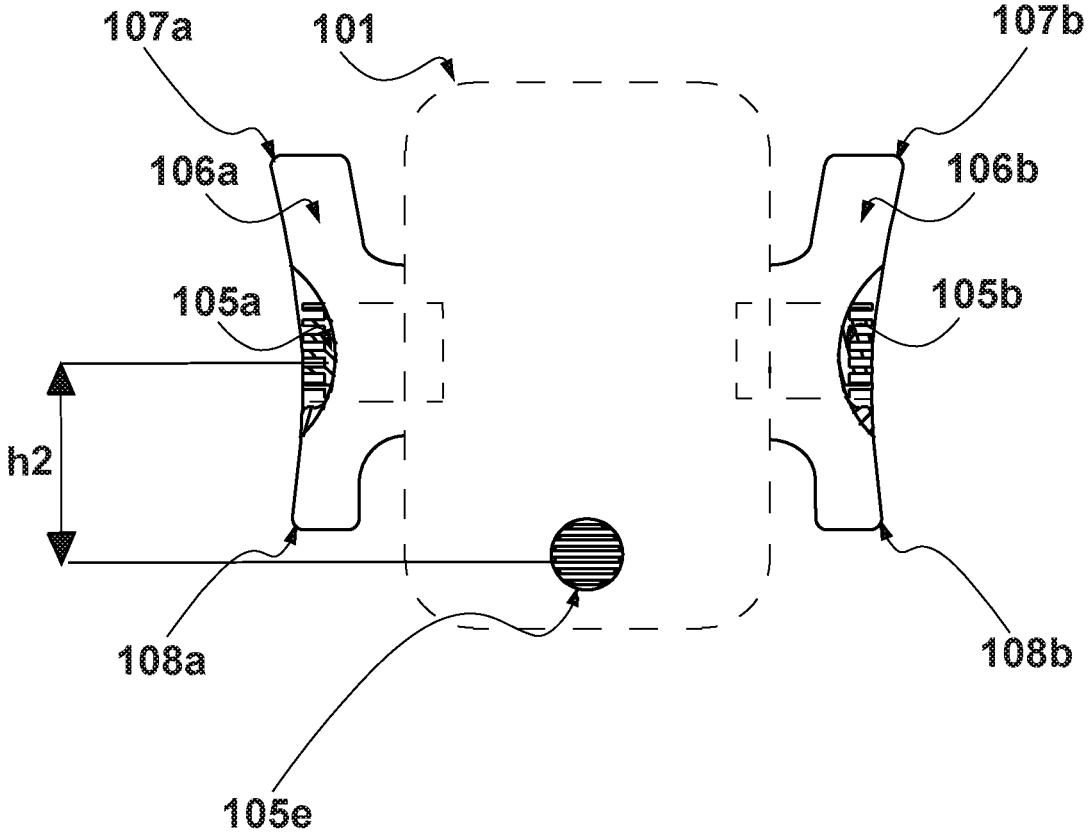
FIG. 38 schematically shows a front view of another exemplary embodiment of the system of binaural recording of FIG. 32 with a frontal microphone capsule, arranged in the dummy head, in a central position with respect to the two lateral microphone capsules and oriented towards a front face of the dummy head.
Figure 39:
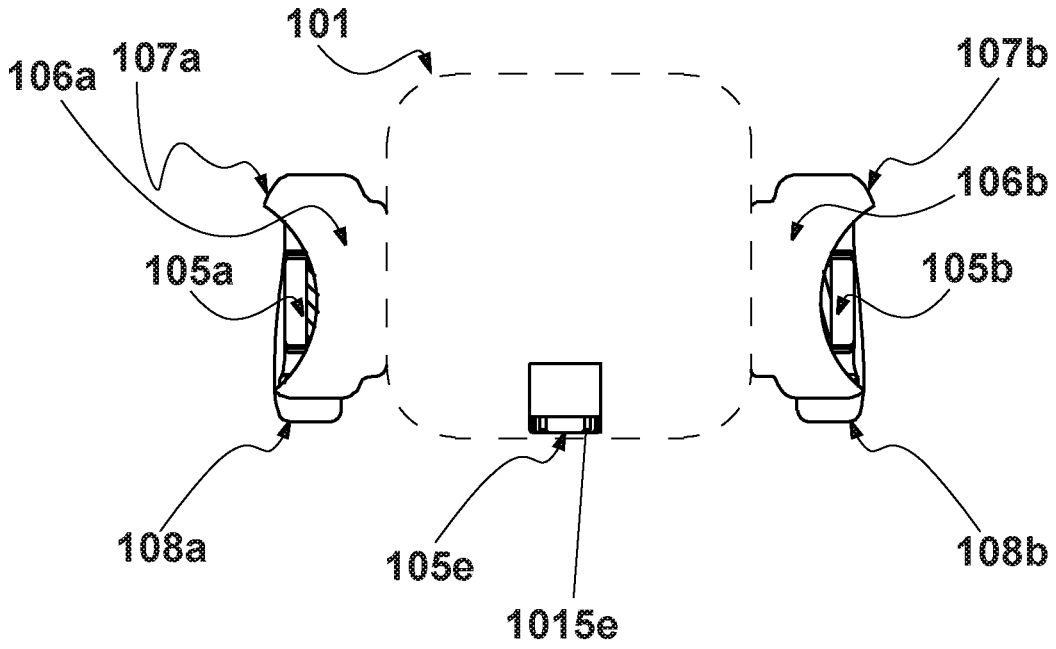
FIG. 39 shows, in a schematic top view, the system of binaural recording of FIG. 38.

With reference to FIGS. 38 and 39, an exemplary embodiment of the improved system of binaural recording comprises two lateral microphone capsules 105*a*, 105*b* located in accordance to what described in the FIGS. 32-35, and a third lateral microphone capsule 105*e* located in front of the dummy head in a lower position with respect to the two lateral microphone capsules 105*a*, 105*b* for a difference in height of h2, for example 4-5 cm. Even in this case a collection of vestibular sensations of sounds is obtained that are coming from the frontal direction of the dummy head 101. This simulates, during listening of the recorded sound, the same sensations coming from the front part of the face of a person, and improves the fidelity with respect to sounds that come from a frontal direction.

Figure 40:
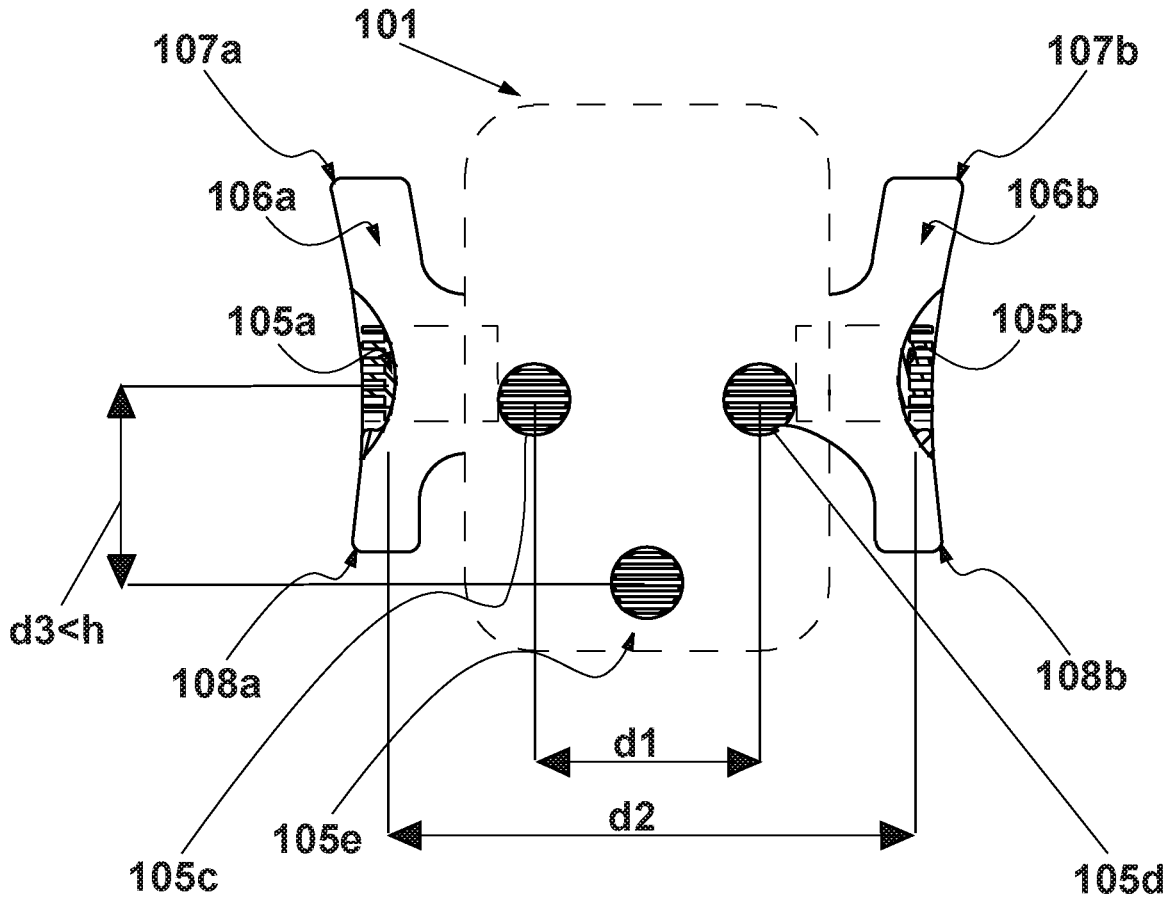
FIG. 40 shows, in a schematic front view, a further exemplary embodiment of the system of binaural recording of FIG. 32 with two lateral microphone capsules and with three front microphone capsules mounted to the dummy head.
Figure 41:
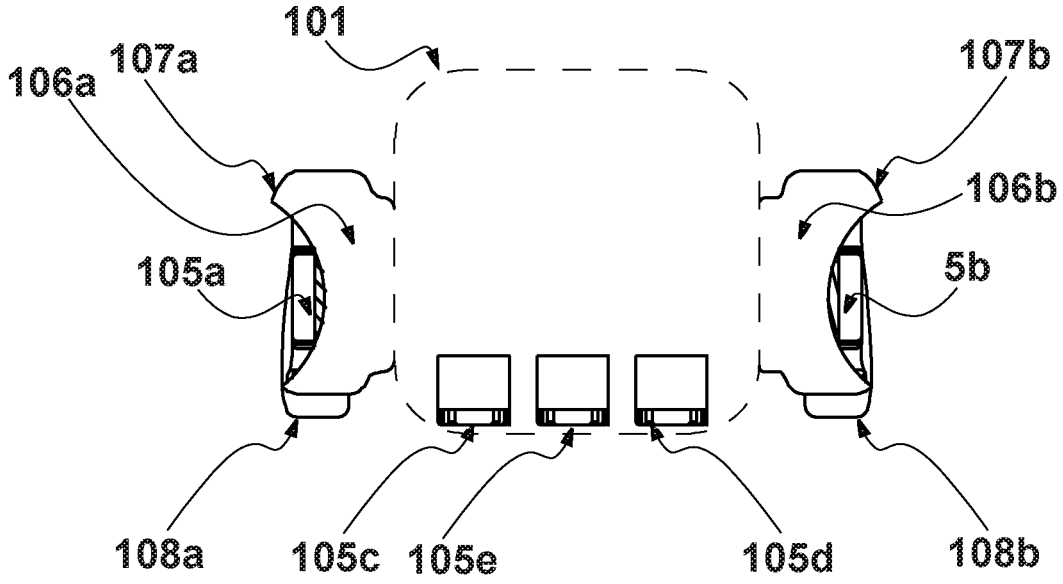
FIG. 41 shows, in a schematic top view, the system of binaural recording of FIG. 40.

With reference to FIGS. 40 and 41, an exemplary embodiment of the improved system of binaural recording comprises two lateral microphone capsules 105*a*, 105*b* located in accordance to what described in the FIGS. 32-35, and three frontal microphone capsules 105*c*, 105*d*, 105*e*, which are located in front of the dummy head in accordance to what described in FIGS. 36, 37, 38, 39. This way, a still higher fidelity is obtained of the collected sounds coming from the frontal direction, thanks to the multiple sound collecting points.

The frontal microphone capsule 105*e* can be in a lower position in a vertical direction (d3<h) with respect to the other two frontal microphone capsules 105*c*, 105*d*, for improving the fidelity of recorded sound with respect to sounds that move in a vertical direction. This way, it is possible to discriminate better the directionality of the sound source moving up to down or vice-versa.

The two frontal microphone capsules 105*c*, 105*d* can be set for recording at a predetermined second intensity less than the first intensity of the lateral microphone capsules 105*a*, 105*b* for a difference in gain in decibel set between 5-8 dB, and the frontal microphone capsule 105*e* is configured for recording at a predetermined third intensity less than the first intensity for a difference in gain in decibel set between 3-5 dB. This way, a reduction of vestibular sensation is reproduced, like the human ear, for sounds moving from a frontal direction that cross the upper skeletal parts of the user's face, with respect to sounds moving from a frontal direction that cross the lower skeletal parts of the user's face.

The frontal microphone capsule 105*e* can be a cardioid capsule. In particular, a filter can be provided that cuts predetermined frequencies with respect to a full range of 1 hz-20 KHz. The filter can cut frequencies under 4-5 KHz and enhance frequencies between 12/20 KHz with a gain of 12 dB. This way, the behavior of the human ear for the sounds moving from a frontal direction that cross the skeletal parts of the face is reproduced. In particular, these sounds are reduced at lower frequencies and enhanced at higher frequencies.

Advantageously, at least one frontal microphone capsules 105*c*, 105*d*, 105*e*, is configured for oscillating a collected signal by an auto-panpot setting. This way, the ear of the listener will be stimulated for sounds coming from a frontal direction. The range of the auto-panpot can be set between a left/center point and a right/center point comprised between 20/30%, and the time for a movement between the left/center point and right/center point is comprised within 20/80 ms.

With reference to FIG. 42, in an exemplary embodiment of the improved system of binaural recording, two lateral microphone capsules 105*a*, 105*b* located in accordance to what described in the FIGS. 32-35 are provided, and two further lateral microphone capsules 109*c*, 109*d* located laterally with respect to the dummy head 101, on the two respective right and left sides, higher than the two lateral microphone capsules 105*a*, 105*b*, and above the auricle (h4>h3) are provided.

The two further lateral microphone capsules 109*c*, 109*d*, which do not have an auricle, add a sound collection to that obtained through the lateral microphone capsules 105*a*, 105*b* located in the auricle 106*a*, 106*b* and above described, obtaining a better distinction between sounds coming frontally and sounds coming laterally.

With reference to FIG. 43, an exemplary embodiment of the improved system of binaural recording comprises four lateral microphone capsules 105*a*, 105*b*, 109*c*, 109*d* located in accordance to what described in the FIGS. 32-35 and in FIG. 42 and three frontal microphone capsules 105*c*, 105*d*, 105*e* in accordance to what described in the FIGS. 38-39 adding the relative effects.

Figure 44:
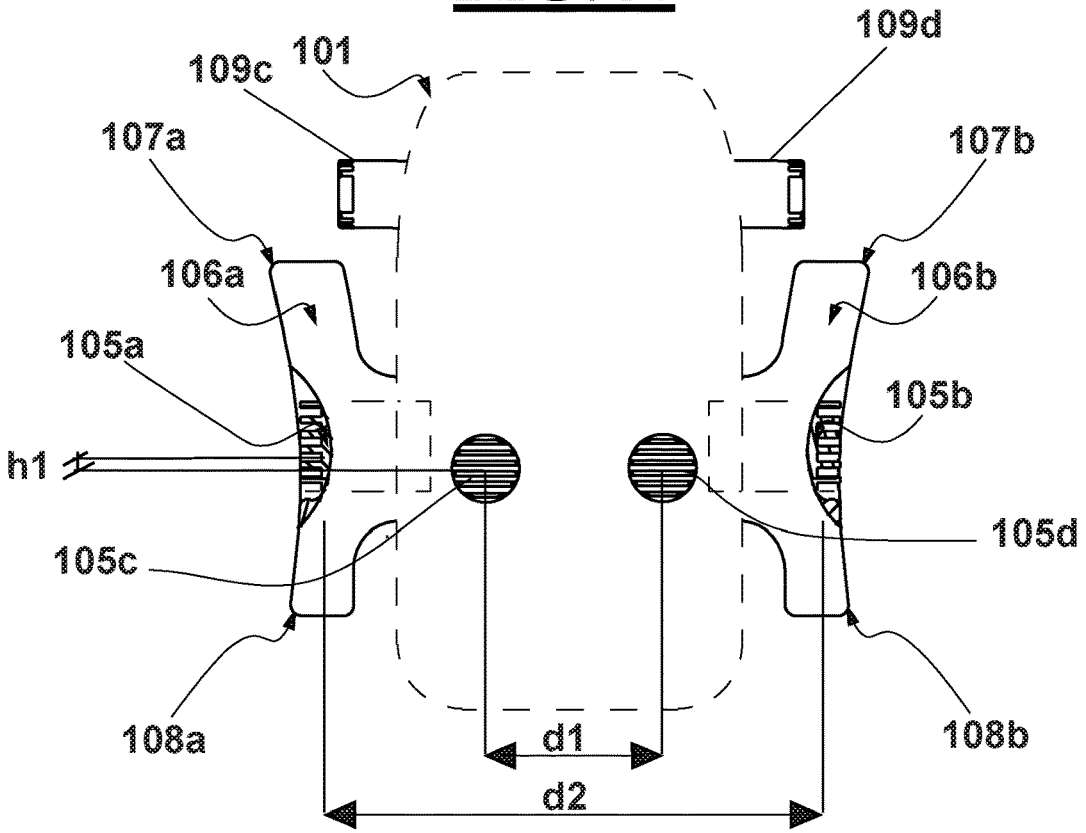
FIG. 44 shows, in a schematic front view, a further exemplary embodiment of the system of binaural recording of FIG. 32 with four lateral microphone capsules and two front microphone capsules.

With reference to FIG. 44, a further exemplary embodiment is shown, with four lateral microphone capsules 105*a*, 105*b*, 109*c*, 109*d* located in accordance to what described in the FIGS. 32-35 and in FIG. 42 and two further frontal microphone capsules 105*c*, 105*d* are provided in accordance to what described in FIGS. 36 and 37 adding the relative effects.

Figure 45:
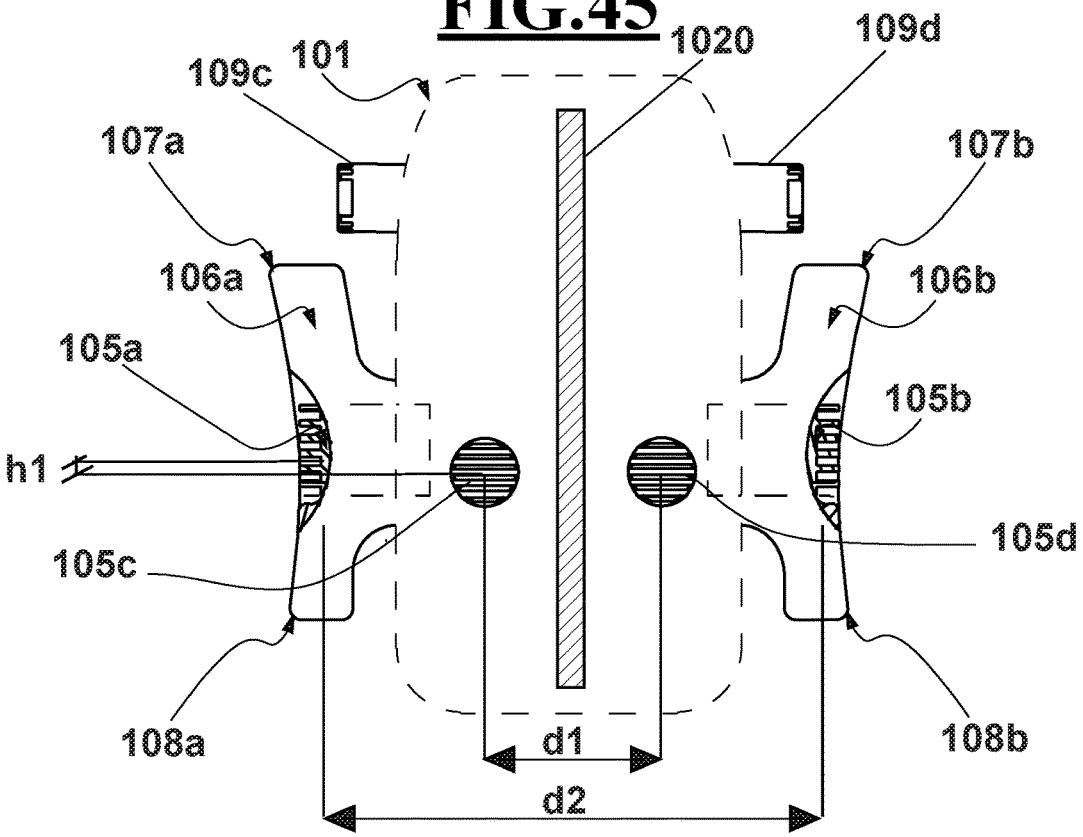
FIG. 45 shows, in a schematic front view, an exemplary embodiment of the system of binaural recording of FIG. 44 wherein between the two frontal microphone capsules a partition wall is arranged.

With reference to FIG. 45 a front view of a system of binaural recording is shown, similar to that of FIG. 44, where a partition wall 1020, located between the two frontal microphone capsules 105*c*, 105*d*, is provided. This way, the presence of the partition wall 1020 determine an acoustic shield that makes it possible to each frontal capsule 105*c*, 105*d* to define the sounds coming from the respective right and left sides.

Figure 46:
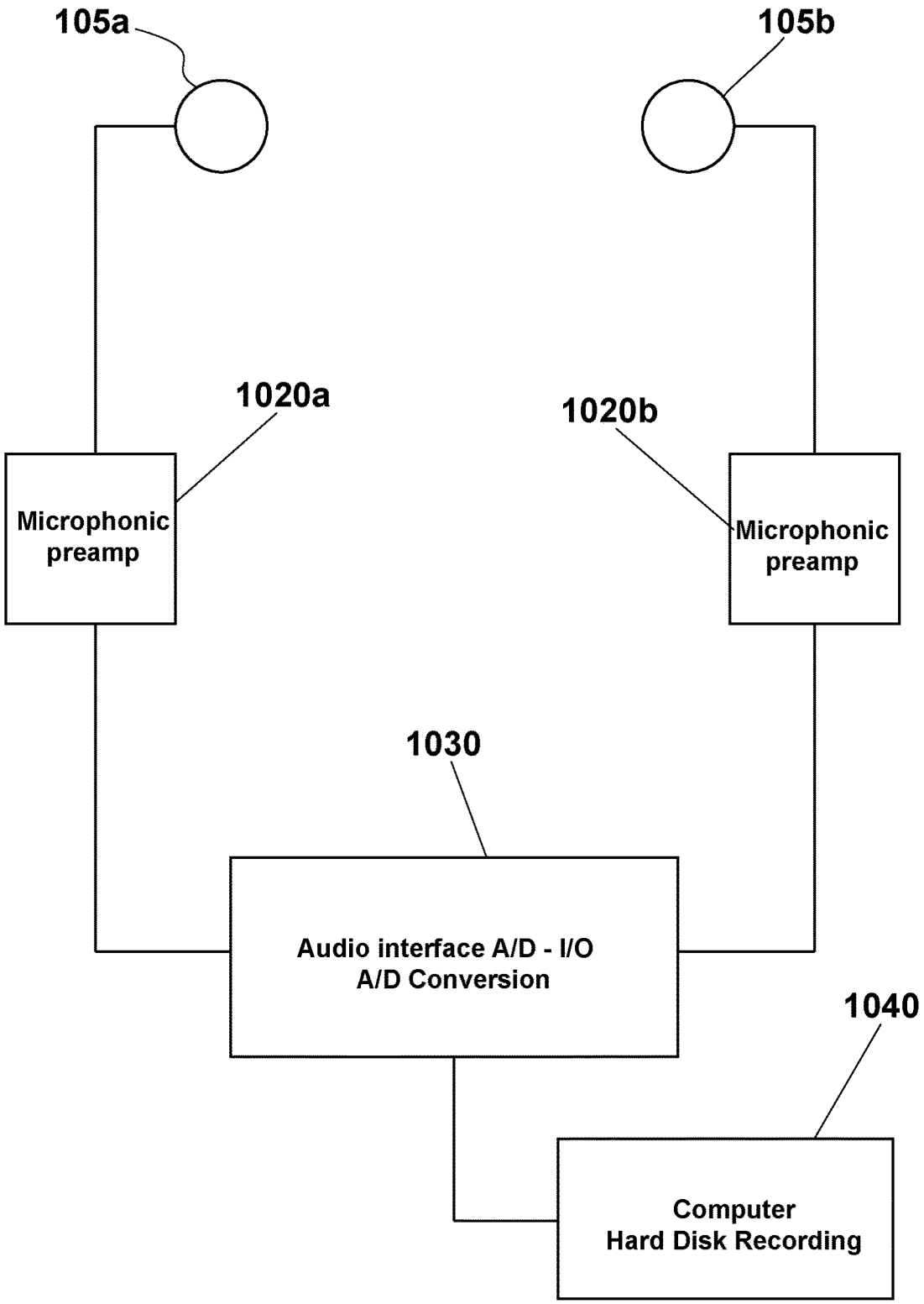
FIG. 46 shows a block diagram of an audio recording comprising the binaural microphone unit of FIGS. 32-35, configured to record sound from a sound source, with the pre-amplification unit, and with a storage unit on a PC.

With reference to FIG. 46 an exemplifying block diagram for the processing phases of the binaural microphone unit is shown, where the two lateral microphone capsules 105*a*, 105*b* acquire an analog signal, coming from the sound source, and send it to the pre-amplification unit. The signal, after processing by the pre-amplification unit is sent to an audio interface for the analog to digital conversion. The digital signal, is then acquired by the recording unit.

Figure 47:
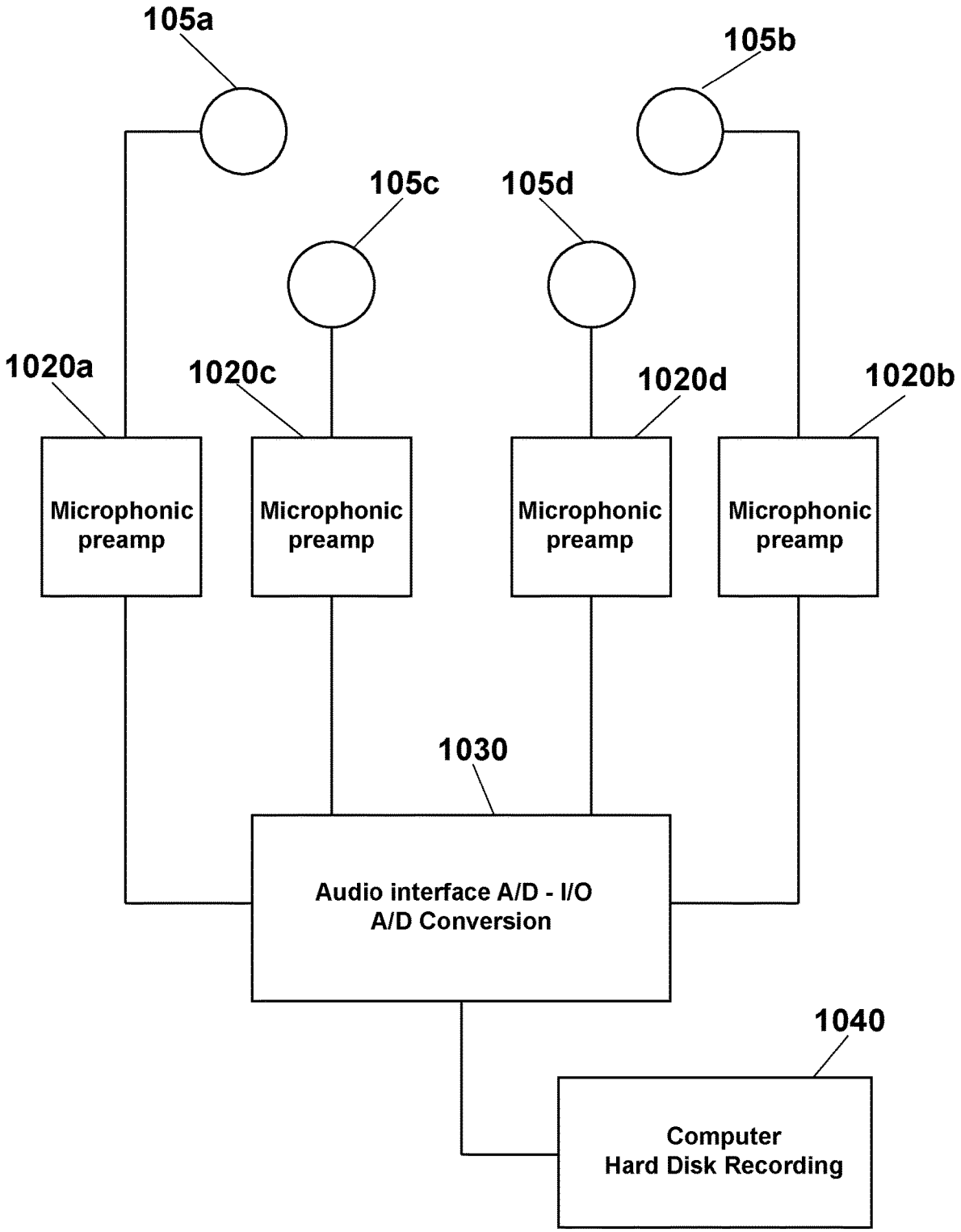
FIG. 47 shows an audio recording block diagram by the binaural microphone unit of FIGS. 36-37, modified with respect to FIG. 42 by the addition of two frontal microphone capsules.

Similarly, FIG. 47 shows a schematic view of the processing phases in the case of four microphone capsules, two lateral 105*a*, 105*b*, and two frontal 105*c*, 105*d*.

Figure 48:
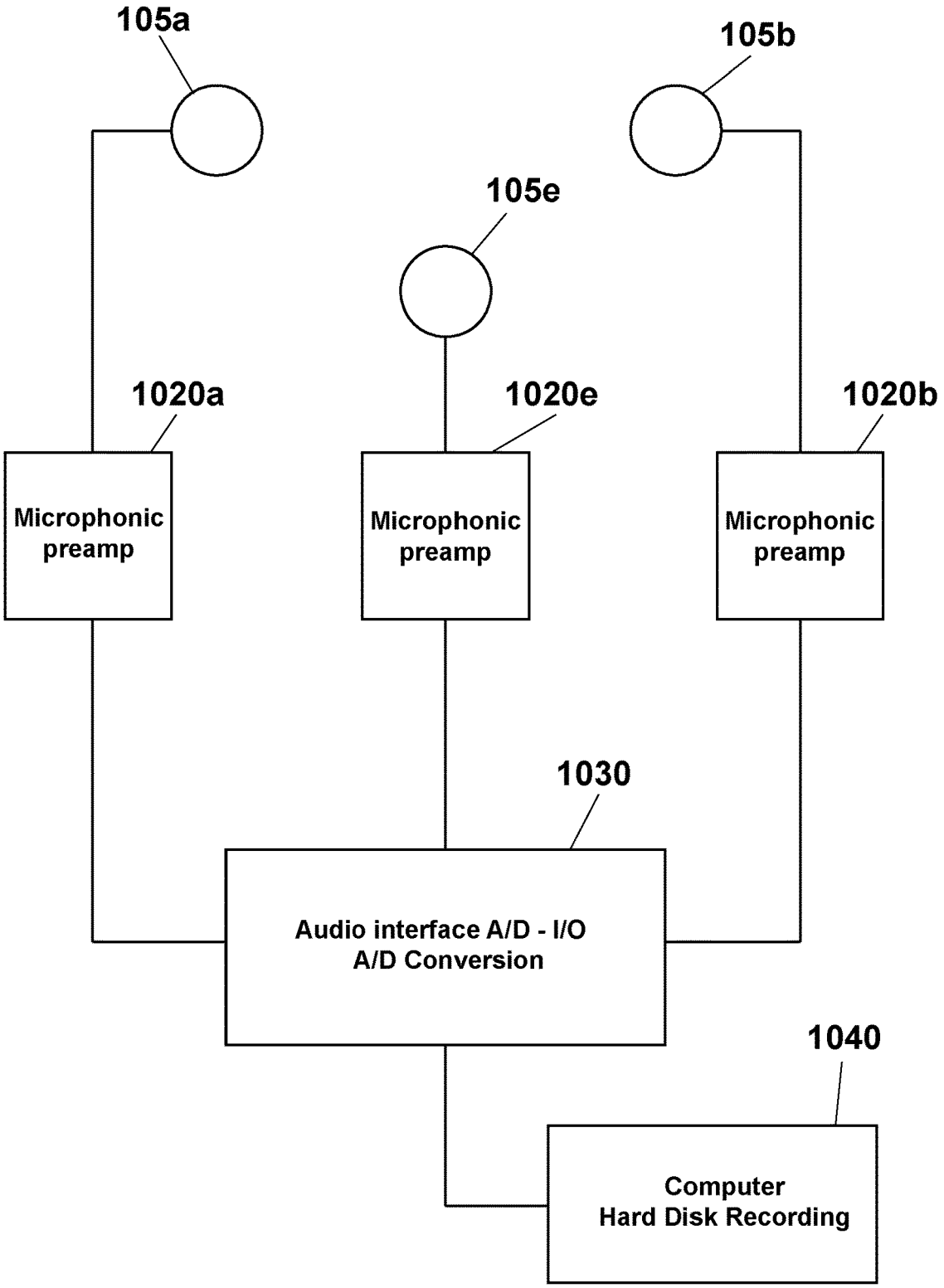
FIG. 48 shows an audio recording block diagram by the binaural microphone unit of FIGS. 38-39 modified with respect to FIG. 32 by the addition of a frontal microphone capsule.

FIG. 48 shows a schematic view of the processing phases in the case of three microphone capsules, two lateral 105*a*, 105*b*, and a frontal 105*e*.

Figure 49:
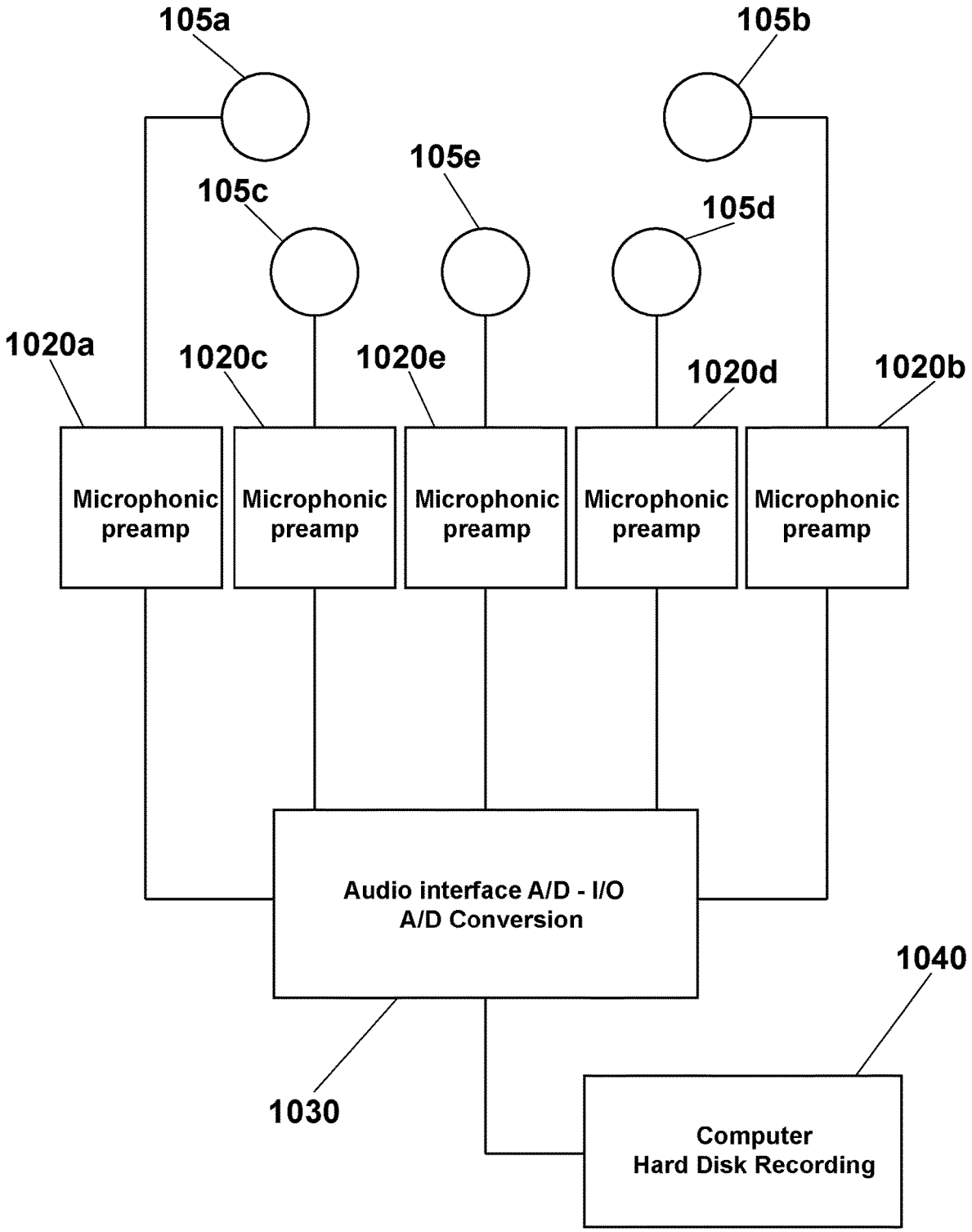
FIG. 49 shows an audio recording block diagram by the binaural microphone unit with three further frontal microphone capsules, arranged to acquire the sound source, with the pre-amplification unit, and with the storage unit on PC.

FIG. 49 shows a schematic view of the processing phases in the case of five microphone capsules, two lateral 105*a*, 105*b*, and three frontal 105*c*, 105*d*, 105*e*. The processing of the sound in the case of four capsules, as shown in FIG. 42, of four lateral capsules and three frontal capsules, as shown in FIG. 43, or of four lateral capsules and two frontal capsules, as shown in FIG. 44, can be obtained.

Figure 50:
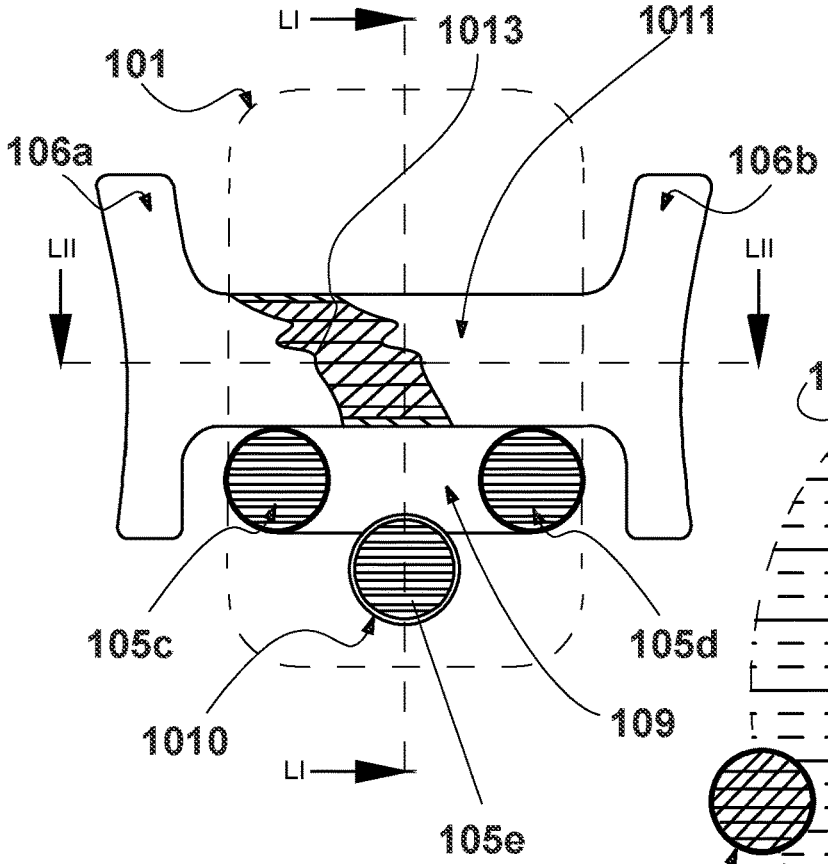
FIG. 50 shows a front view of the improved system of binaural recording, wherein the microphone capsules are placed within the housings configured for acoustic insulation.
Figure 51:
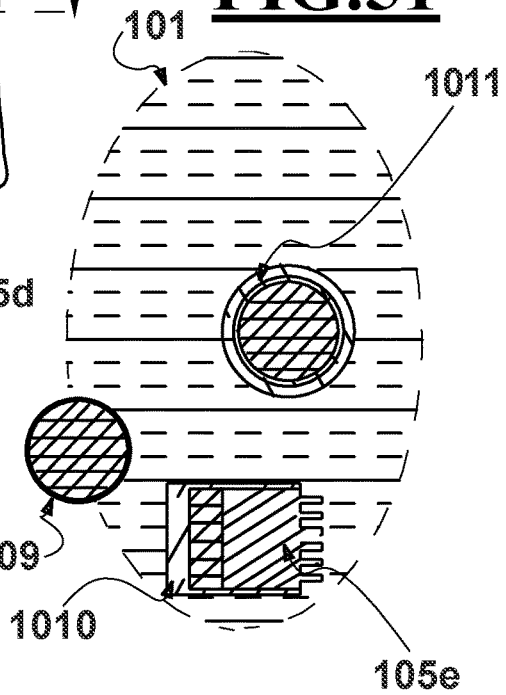
FIG. 51 shows a cross section of the improved system of binaural recording, wherein the microphone capsules are placed within housings configured for acoustic insulation.

FIGS. 50 to 51 show a front view (FIG. 50) and two cross section views LI-LI (FIG. 51) and LII-LII (FIG. 52), of a possible embodiment of the binaural system according to the invention. The exemplary embodiment of FIGS. 40 and 41, with two lateral microphone capsules 105*a*, 105*b* and three frontal microphone capsules front 105*c*, 105*d*, 105*e* is used, as an example. A person skilled in the art can obviously extend this exemplary embodiment to the other cases shown above.

Figure 52:
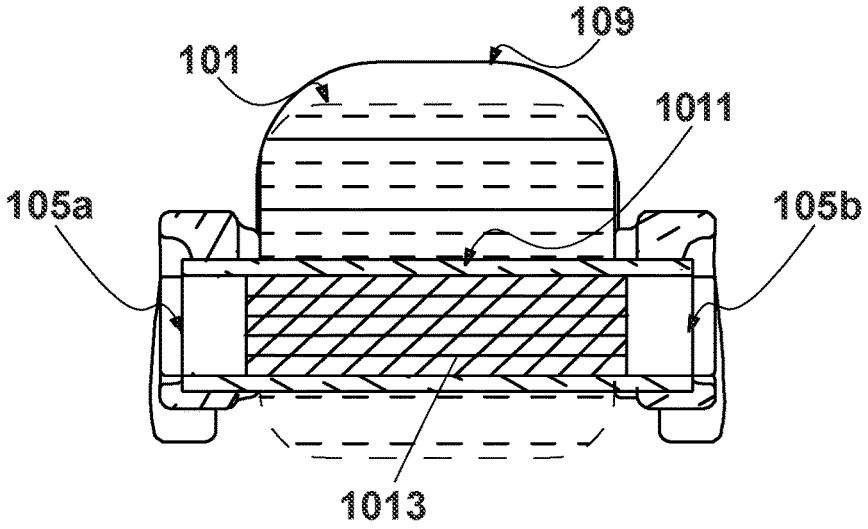
FIG. 52 shows a further cross section of the improved system of binaural recording, wherein the microphone capsules are placed within housings configured for acoustic insulation.

In FIGS. 50-52, the elements 109, 1010, 1011, are the rest elements belonging to the two frontal microphone capsules 105*c*, 105*d*, and the further frontal microphone capsules 105*e* and the two lateral microphone capsules 105*a*, 105*b*. The dummy head 101 can be made of an acoustically insulating material, for example a foam with open or closed cells, such as polyurethane, including a rigid frame 1011 for the support of the auricles 106*a*, 106*b*. The rigid frame is arranged to reduce vibrations at low frequency. Moreover, the elements 109, 1010, 1011 are contained in the rigid frame.

As shown in FIGS. 51 and 52, the element 1011 is a tubular element made of plastic material selected from the group consisting of: nylon, polyethylene, etc. that can be filled with a light soundproofing material 13, for example polyurethane foam, wool, etc.

The element 109 has a tubular shape and is placed into the body of the soundproofing material, and preferably it is not in contact with the tubular element 11 used to support the lateral microphone capsules 105*a*-105*e* of the auricles. This way noise affecting the sound recording can be reduced.

Figure 53:
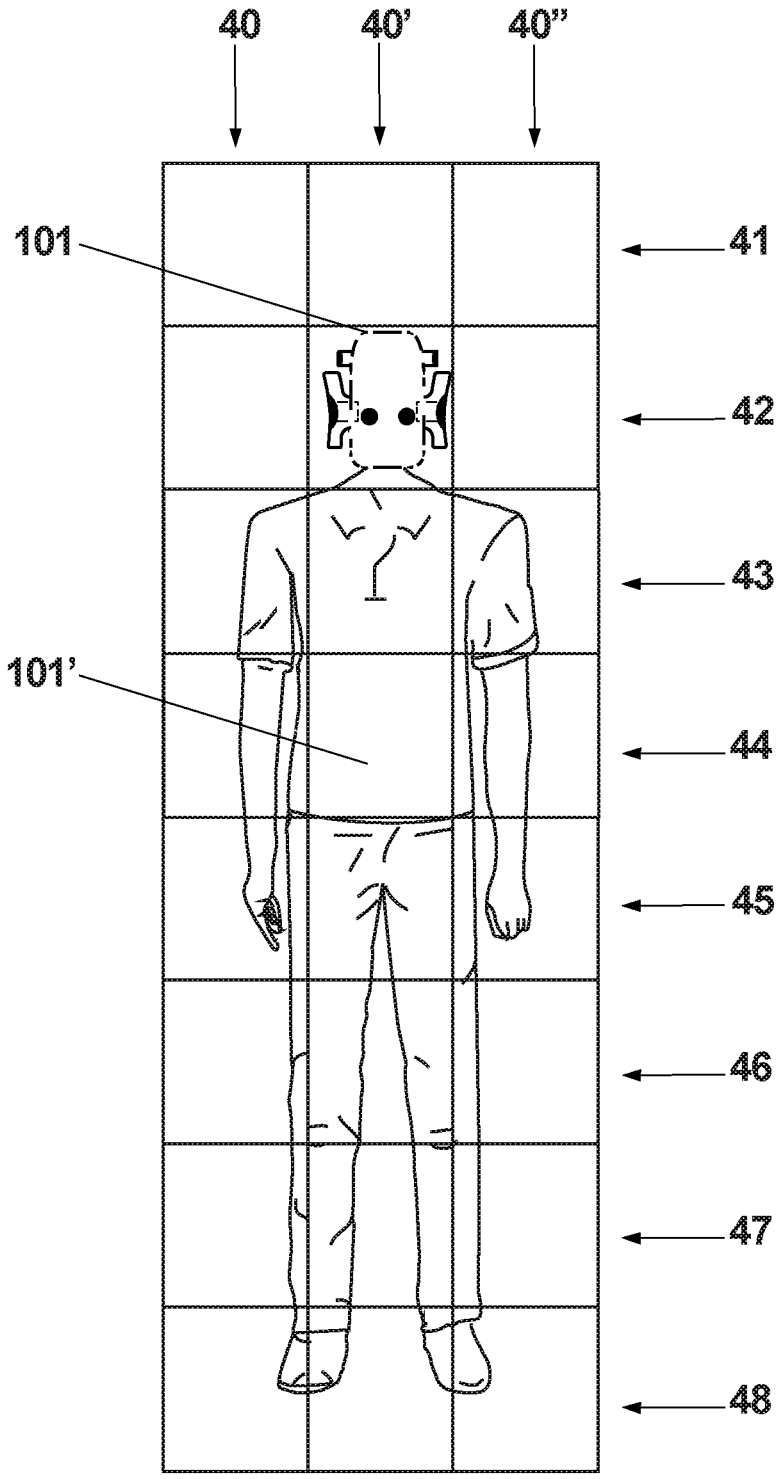
FIG. 53 shows a schematic view of an exemplary embodiment of a system, according to the invention, using the system of binaural recording of FIGS. 32-52, recording a plurality of audio tracks each relative to sounds originated in a predetermined position with respect to the system of binaural recording.

With reference to FIG. 53, an exemplary embodiment is shown of a system of reproduction, according to the invention wherein, using the system of binaural recording of FIGS. 32-52, according to which a plurality of audio tracks are recorded, each relative to sounds originated in a predetermined position with respect to the system of binaural recording 101. In particular, each position of the space is referred to a body part identified using a body object 101' configured for simulating a human body.

In the example described in FIG. 53, a body object 101' is associated to the system of binaural recording and define the positions of the parts of a human body, whose head is the system of binaural recording 101. An ideal partition is made of the bi-dimensional space within which the body is contained, in order to identify an m×n matrix of areas which overlap to body object 101'. In particular, each area is the result of the combination of m lines and n columns. In the example described in Fig., for each area of the matrix m×n a sound source is activated in a predetermined position mn, which is acquired by the system of binaural recording 101. The sound source is then activated in all the other positions mn, and each time a recording is done, obtaining a relative track audio. This way, a plurality of audio tracks is made, each relative to a sound generated in a position mn selected between a combination of m lines 41, 42, 43, 44, 45, 47, 48, 49 and n columns 40, 40', 40" of the matrix.

Being the system of binaural recording 101 capable of keeping the information relative to the direction of the sound sources, the high fidelity audio tracks thus generated can be played with a reproduction system of the same fidelity level like the one above described with reference to the FIGS. 1-30.

Figure 54:
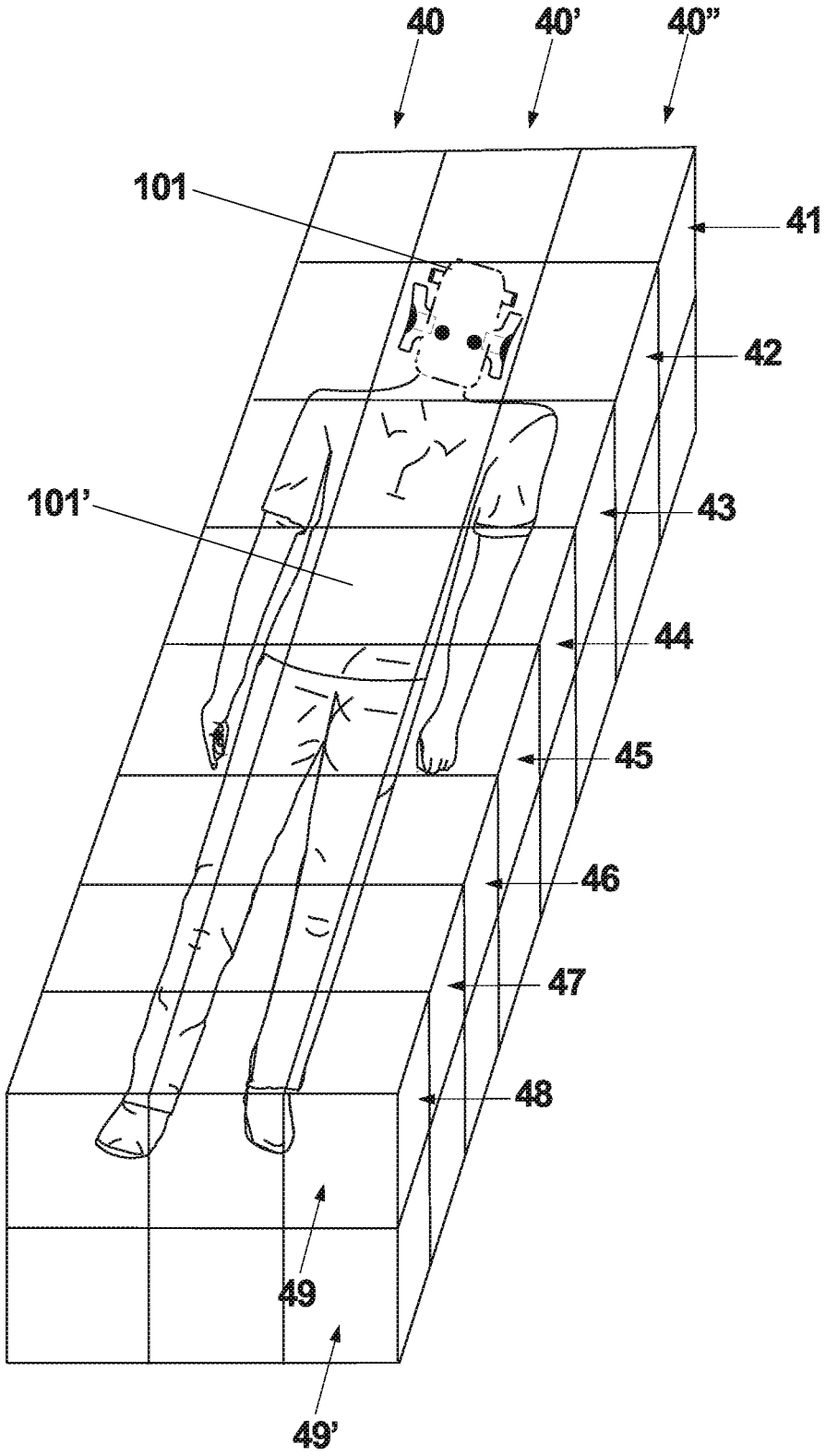
FIG. 54 shows a further exemplary embodiment of FIG. 53.

With reference to FIG. 54, an exemplary embodiment of the invention is shown, similar to that of FIG. 53, where it is shown a partition of a three-dimensional space which contains the object 101' and the system of binaural recording 101. This way, one additional spatial dimension is obtained for the audio tracks. In particular, the sound source can be activated in any position mn of FIG. 53, above or below the object 101' that simulate the patient's body.

Such audio tracks, used in combination with a mobile device 980 and a head support for audio reproduction, allow the patient to listen sounds that are perceived as coming from the position mn in which the sound source has been activated during recording. Combining more audio tracks it is possible to reproduce sounds that move with respect to the patient, in a predetermined way according to the cells mn chosen for reproduction. For example, it can be produced audio tracks that make the patient perceive sounds that move up to down or vice-versa.

It is also possible to record audio tracks relative to moving sound sources, which cross more zones mn. In this case such audio tracks that cover more zone can be played choosing the relative positions for reproduction, as hereinafter described.

Figure 55:
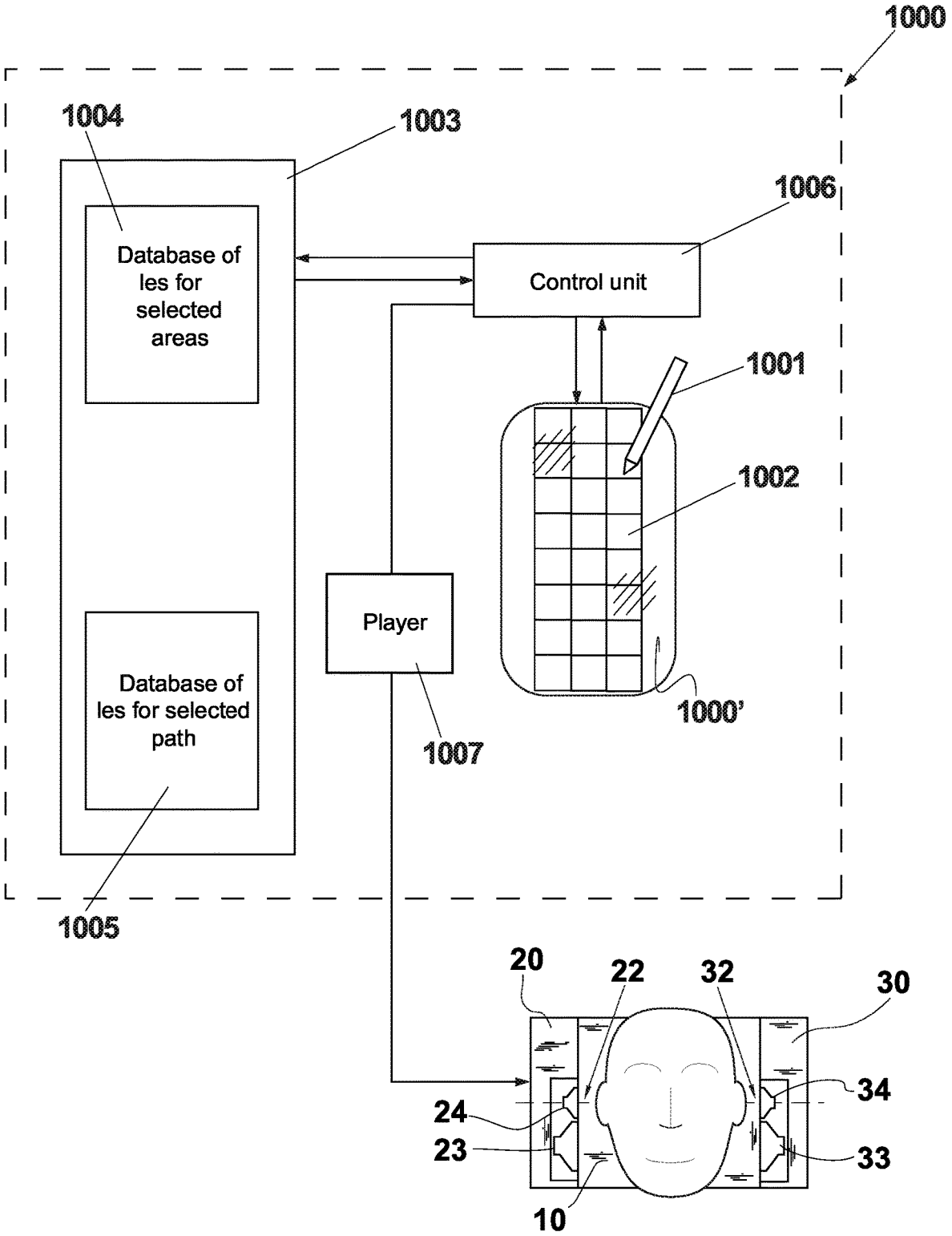
FIG. 55 shows a block diagram of the software for the reproduction of audio tracks recorded as described in FIGS. 53-54.

With reference to FIG. 55 a block diagram shows a possible exemplary embodiment of the system, installed in an interface 1000, for reproduction of a plurality of audio tracks, each acquired as described in FIGS. 53, 54. Through the interaction with the interface, for example by a pointing device 1001, the user that is located on the support experience listening of audio tracks that are felt as coming from audio source located by the respective body parts.

If the interface 1000 is either a tablet or a smartphone, it can be equipped with touch screen 1000' where it is given an image 1002 depicting a body and a plurality of areas overlapped to body parts. In particular, the user, for example a patient that is located on the support of audio reproduction, or a therapist that wishes the patient to perceive some chosen sounds, interacting with the image 1002, controls reproduction of audio tracks recorded with the criteria above described. Such controls can be performed both by a selection of the areas present in the image 1002, near body parts, and by a selection of a stimulation path which runs through a predetermined succession of areas of the image 1002. A database 1003 can contain both audio tracks of recordings relative to predetermined body parts 1004, and audio tracks relative to paths 1005 that cross multiple body parts. A control unit 1006, present in the software, is adapted to control the head support in order to reproduce the audio tracks obtained by the system of binaural recording. The audio tracks activated are sent to the head support for audio reproduction by wireless connection or by cable connection by means of a player 1007. For example, it can be played a sound perceived at the height of the right foot of the patient, or a sound that moves from the right edge of the foot to the head, and the like.

Figure 56:
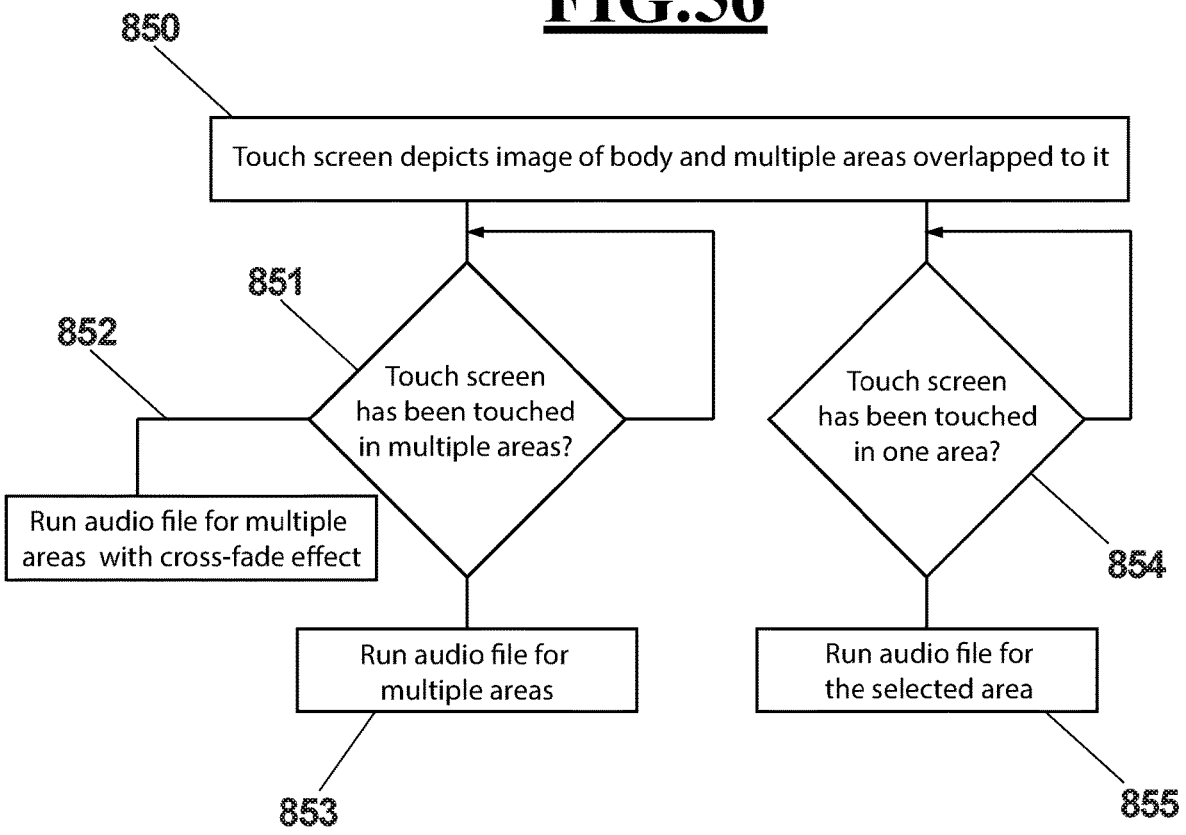
FIG. 56 shows a flow-sheet for reproduction of audio tracks acquired as described in the examples of FIGS. 53-54.

FIG. 56 shows a flow-sheet for reproduction of audio tracks as a result of the interaction with the interface 1000. The user, at the beginning of session 850, interacts with the touch screen 1000' of the interface 1000 to provide the stimulation controls. If the user has provided controls for multiple areas 851 of the touch screen, an audio track for selected areas 853 is carried out, or a track audio comprising a path of multiple areas 852, with possibility of cross fading among the various areas. If the user has provided controls for a single area 855, a track audio for the selected area is performed.

The foregoing description of some exemplary specific embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A head support incorporating loudspeakers arranged for playing multi-dimensional acoustic effects comprising:

a rest element for the head of a user, made of a deformable material;

a right lateral support element and a left lateral support element located respectively at the two respective right and left sides of said rest element, said right and left lateral support elements being connected to each other by said rest element, said right and left lateral support elements defining between each other a listening space and a longitudinal direction parallel to said lateral support elements;

a right loudspeaker and a left loudspeaker mounted respectively to said right and left lateral support elements, said right and left loudspeakers having respective sound emission faces that face towards said listening space;

said rest element providing a housing zone for a portion of the head configured to arrange the user with right and left ears oriented towards said right and left loudspeakers, said right and left ears creating a listening axis, wherein said loudspeakers have each a woofer and a tweeter, said tweeter having an axis of symmetry, said loudspeakers mounted to said right and left lateral support elements so that said tweeters are oriented towards said listening space and having said axes of symmetry oriented with a predetermined angle of elevation (a) with respect to said listening axis between a first elevation value (a) substantially equal to zero, where said tweeters have said axes of symmetry aligned to each other and parallel to said listening axis, and a second elevation value (a) substantially equal to 45°, where said tweeters have said axes of symmetry converging towards a point that is located opposite to said housing zone with respect to said listening axis, and wherein said tweeters have a center, said center arranged at a same level or shifted from said listening axis for a predetermined distance (z), set between 0 and 5 cm, in a direction opposite to said housing zone, and wherein said center is also shifted in said longitudinal direction proximally with respect to said user for a predetermined distance, set between 0 and 10 cm.

2. A head support according to claim 1, wherein in said first position said tweeters are arranged in such a way that when said user has the head resting on said housing said axes of symmetry coincides substantially with said listening axis.

3. A head support according to claim 1, wherein said tweeters and said woofers are arranged oriented in a predetermined direction and said direction is at an angle in a horizontal plane by a predetermined inclination angle set in a range selected from the group consisting of: between 0° and 45°, between 0° and 35°.

4. A head support according to claim 1, wherein said tweeter and said woofer are arranged in a predetermined direction and said direction is oriented in a vertical plane by a predetermined angle of orientation set between 0° and 10°.

5. A head support according to claim 1, wherein said rest element provides a receiving recess arranged to, at the rest element, to arrange a head portion of said user, said receiving recess being symmetric with respect to said longitudinal direction.

6. A head support according to claim 1, wherein said right and left tweeters are arranged to be electrically exchanged with each other and said right and left woofer are electrically exchanged with each other, maintaining the multidimensional effect on the user.

7. A head support according to claim 1, sensors are provided located on said rest element and arranged to interact with the user, for measuring the movement of the head of the user, or the pressure of the user on the rest element, and arranged to provide indications on the status of the user, identifying the movement of the head and of the eyes, allowing the interaction with the software contents of the support.

8. A head support according to claim 1, wherein loudspeakers are further provided, which are located in said listening space, in such a way to form with said loudspeakers a surround listening arrangement.

9. A head support according to claim 1, wherein an articulated structure is provided arranged to support a mobile device and arranged to be seen by a user resting on the rest element, said articulated structure arranged to be adjustable in order to adjust the position of said mobile device.

10. A system for distributing multi-dimensional acoustic effects comprising:

a head support incorporating loudspeakers comprising:

a rest element for the head of a user, made of a deformable material;

a right lateral support element and a left lateral support element located respectively at the two respective right and left sides of said rest element, said right and left lateral support elements being connected to each other by said rest element, said right and left lateral support elements defining between each other a listening space and a longitudinal direction parallel to said lateral support elements;

a right loudspeaker and a left loudspeaker mounted respectively to said right and left lateral support elements, said right and left loudspeakers having respective sound emission faces that face towards said listening space;

said rest element providing a housing zone for a portion of the head configured to arrange the user with right and left ears oriented towards said right and left loudspeakers, said right and left ears creating a listening axis, characterized in that said loudspeakers have each a woofer and a tweeter, said tweeter having an axis of symmetry, said loudspeakers mounted to said right and left lateral support elements so that said tweeters are oriented towards said listening space and having said axes of symmetry oriented with a predetermined angle of elevation with respect to said listening axis between a first elevation value substantially equal to zero, where said tweeters have said axes of symmetry aligned to each other and parallel to said listening axis, and a second elevation value substantially equal to 45°, where said tweeters have said axes of symmetry converging towards a point that is located higher than said listening axis;

a memory unit containing a plurality of audio tracks, each audio track being acquired by a system of binaural recording associated with an object defining the encumbrance of a human body, each audio track of said plurality being associated with at least one predetermined body part at which a sound source has been arranged at the time of recording, a control unit arranged to transmit to said head support incorporating loudspeakers said audio tracks;

an input interface, connected to said control unit and configured to graphically display a representation of said or each of body part, and to allow selecting at least one body part;

said control unit configured in such a way that, when said or each body part, which is present in the interface, is selected, said control unit causes the loudspeakers of said support to reproduce at least one audio track associated with said at least one selected body part.

* * * * *